US009519245B2

(12) United States Patent
Nagata et al.

(10) Patent No.: US 9,519,245 B2
(45) Date of Patent: Dec. 13, 2016

(54) IMAGE FORMING APPARATUS

(71) Applicants: Haruki Nagata, Kanagawa (JP); Ryo Hasegawa, Kanagawa (JP); Naoto Kochi, Kanagawa (JP); Atsushi Nagata, Kanagawa (JP); Takahiro Konishi, Kanagawa (JP)

(72) Inventors: Haruki Nagata, Kanagawa (JP); Ryo Hasegawa, Kanagawa (JP); Naoto Kochi, Kanagawa (JP); Atsushi Nagata, Kanagawa (JP); Takahiro Konishi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/712,307

(22) Filed: May 14, 2015

(65) Prior Publication Data

US 2015/0346651 A1 Dec. 3, 2015

(30) Foreign Application Priority Data

May 27, 2014 (JP) ..... 2014-109287

(51) Int. Cl.
*G03G 15/16* (2006.01)

(52) U.S. Cl.
CPC ..... *G03G 15/1665* (2013.01); *G03G 15/1605* (2013.01); *G03G 2215/00738* (2013.01); *G03G 2215/0193* (2013.01)

(58) Field of Classification Search
CPC ..... G03G 15/1665; G03G 15/1605; G03G 2215/0193; G03G 2215/00738
See application file for complete search history.

(56) References Cited

U.S. PATENT DOCUMENTS

2009/0003898 A1 1/2009 Kayahara et al.
2009/0016786 A1 1/2009 Suzuki et al.
(Continued)

FOREIGN PATENT DOCUMENTS

EP 2395401 A1 12/2011
JP 2007-139915 A 6/2007
(Continued)

OTHER PUBLICATIONS

Office Action for corresponding European patent application No. 15168004.8 dated Oct. 22, 2015.

*Primary Examiner* — G. M. Hyder
(74) *Attorney, Agent, or Firm* — Harness, Dickey & Pierce, P.L.C.

(57) ABSTRACT

An image forming apparatus includes an image bearer, a nip forming device, a contact-and-separation device, a thickness information retrieving device, and a controller. The contact-and-separation device moves the image bearer and the nip forming device to contact and separate from each other. The controller controls the contact-and-separation device based on information on a thickness of a recording medium obtained by the thickness information retrieving device such that in a case in which a thickness of a preceding recording medium and a thickness of a successive recording medium are different in continuous printing in which a plurality of recording media is printed out continuously, the contact-and-separation device adjusts a space between the image bearer and the nip forming device when the preceding recording medium exits the transfer nip to a preset size corresponding to the thickness of the successive recording medium that enters the transfer nip.

18 Claims, 7 Drawing Sheets

(56) References Cited

U.S. PATENT DOCUMENTS

| | | | | |
|---|---|---|---|---|
| 2009/0116880 | A1 | 5/2009 | Takagaki et al. | |
| 2009/0207461 | A1 | 8/2009 | Hodoshima et al. | |
| 2010/0014897 | A1 | 1/2010 | Seto et al. | |
| 2010/0014903 | A1 | 1/2010 | Seto et al. | |
| 2010/0142985 | A1 | 6/2010 | Minbe et al. | |
| 2010/0232844 | A1 | 9/2010 | Saito et al. | |
| 2010/0239292 | A1 | 9/2010 | Fujita et al. | |
| 2011/0091256 | A1 | 4/2011 | Nozawa et al. | |
| 2011/0158690 | A1 | 6/2011 | Mimbu et al. | |
| 2011/0311249 | A1 | 12/2011 | Kubota et al. | |
| 2012/0008991 | A1 | 1/2012 | Shimizu | |
| 2012/0121293 | A1 | 5/2012 | Mimbu et al. | |
| 2013/0045031 | A1 | 2/2013 | Nagata et al. | |
| 2014/0072340 | A1* | 3/2014 | Kato ..... | G03G 15/1605 399/121 |
| 2014/0147160 | A1 | 5/2014 | Konishi | |
| 2014/0270819 | A1 | 9/2014 | Wada et al. | |
| 2014/0328604 | A1 | 11/2014 | Tanaka et al. | |
| 2014/0334847 | A1* | 11/2014 | Takahashi ..... | G03G 15/1605 399/121 |
| 2015/0037054 | A1 | 2/2015 | Nagata et al. | |
| 2015/0043928 | A1 | 2/2015 | Konishi et al. | |
| 2015/0050080 | A1 | 2/2015 | Morita et al. | |

FOREIGN PATENT DOCUMENTS

| | | |
|---|---|---|
| JP | 2007-286382 | 11/2007 |
| JP | 2010-134125 | 6/2010 |
| JP | 2010-134142 | 6/2010 |
| JP | 2011-133653 | 7/2011 |
| JP | 2012-123370 | 6/2012 |

* cited by examiner

FIG. 11

| SUCCESSIVE SHEET→ | α (= HOME POSITION B WHEN SHEET ENTERS) | | | β (= HOME POSITION C WHEN SHEET ENTERS) | | | γ (= HOME POSITION C WHEN SHEET ENTERS) | | | Z (= HOME POSITION A WHEN SHEET ENTERS) | | |
|---|---|---|---|---|---|---|---|---|---|---|---|---|
| PRECEDING SHEET→ | WHEN SHEET ENTERS | DURING PRINTING | WHEN SHEET EXITS | WHEN SHEET ENTERS | DURING PRINTING | WHEN SHEET EXITS | WHEN SHEET ENTERS | DURING PRINTING | WHEN SHEET EXITS | WHEN SHEET ENTERS | DURING PRINTING | WHEN SHEET EXITS |
| α | B | B | B | B | B | C | B | B | C | B | B | A |
| β | C | B | B | C | B | C | C | B | C | C | B | A |
| γ | C | B | B | C | B | C | C | B | C | C | B | A |
| Z | A | B | B | A | B | C | A | B | C | A | B | A |

IMAGE FORMING APPARATUS

CROSS-REFERENCE TO RELATED APPLICATIONS

This patent application is based on and claims priority pursuant to 35 U.S.C. §119 to Japanese Patent Application No. 2014-109287, filed on May 27, 2014, in the Japan Patent Office, the entire disclosure of which is hereby incorporated by reference herein.

BACKGROUND

1. Technical Field

Exemplary aspects of the present disclosure generally relate to a transfer device and an image forming apparatus including the transfer device, and more particularly to an image forming apparatus such as a copier, a facsimile machine, and a printer.

2. Description of the Related Art

There is known an image forming apparatus equipped with a transfer device that transfers a toner image from an image bearer onto a recording medium interposed in a so-called transfer nip at which the image bearer and a nip forming device contact. A transfer bias is applied to the transfer nip by a transfer bias power source to transfer the toner image from the image bearer onto the recording medium.

As an example of such a transfer device, a secondary transfer device is known to transfer secondarily a composite toner image formed on an intermediate transfer belt onto the recording medium. Initially, toner images formed on a plurality of photoconductors are transferred onto the intermediate transfer belt in primary transfer nips at which the photoconductors and the intermediate transfer belt contact such that the toner images are superimposed one atop the other, thereby forming the composite toner image. The composite toner image is then transferred secondarily from the intermediate transfer belt to the recording medium by the secondary transfer device.

The secondary transfer device includes a secondary transfer roller as a nip forming device and a secondary-transfer opposed roller. The secondary transfer roller contacts the intermediate transfer belt serving as the image bearer. The secondary-transfer opposed roller is disposed opposite the secondary transfer roller via the intermediate transfer belt and contacts the intermediate transfer belt from the back thereof. The intermediate transfer belt is interposed between the secondary transfer roller and the secondary-transfer opposed roller to form a secondary transfer nip.

When the recording medium enters and exits the secondary transfer nip, producing impact, the traveling speed of the intermediate transfer belt changes suddenly which then causes an image to be transferred onto the intermediate transfer belt from the photoconductor in the primary transfer nip to stretch or shrink undesirably. As a result, the density of toner changes at a place where the density is expected to be constant, thereby generating undesirable streaking or a so-called shock jitter.

In view of the above, a known image forming apparatus includes a contact-and-separation device that moves an intermediate transfer belt and a secondary transfer roller to contact and separate from each other. Before the recording medium enters the secondary transfer nip, an eccentric cam of the contact-and-separation device separates the secondary transfer roller from the intermediate transfer belt. Accordingly, the secondary transfer roller and the intermediate transfer belt are separated, and a certain space is formed therebetween, hence reducing shock jitter when the recording medium enters the secondary transfer nip.

Furthermore, immediately after the leading end of the recording medium enters the space, the secondary transfer roller is released by the eccentric cam and is pushed against the intermediate transfer belt by a spring. In this configuration, the secondary transfer roller contacts the intermediate transfer belt, and adequate transfer pressure is obtained at the secondary transfer nip during transfer, thereby preventing transfer failure.

After the image on the intermediate transfer belt is transferred onto the recording medium, but before the recording medium exists the secondary transfer nip, the eccentric cam of the contact-and-separation device separates the secondary transfer roller from the intermediate transfer belt by the same predetermined amount. In this configuration, the secondary transfer roller and the intermediate transfer belt are separated when the recording medium exits the secondary transfer nip, hence reducing shock jitter when the recording medium exits the secondary transfer nip.

The smaller is the transfer pressure, the smaller is the impact when the recording medium enters and exits. Therefore, if the intermediate transfer belt and the secondary transfer roller are separated completely and hence there is no transfer pressure, the recording medium can enter and exit the secondary transfer nip without producing shock jitter.

However, when the intermediate transfer belt and the secondary transfer roller come in contact again, the secondary transfer roller strikes the intermediate transfer belt due to spring force of the spring, thereby producing impact. The larger is the space between the intermediate transfer belt and the secondary transfer roller, the greater is the impact. As a result, the traveling speed of the intermediate transfer belt changes suddenly, causing shock jitter.

In this configuration, the larger is the space between the secondary transfer roller and the intermediate transfer belt, the less is the impact generated when the recording medium enters the secondary transfer nip. However, the impact is greater when the intermediate transfer belt contacts the secondary transfer roller.

SUMMARY

In view of the foregoing, in an aspect of this disclosure, there is provided an improved image forming apparatus including an image bearer, a nip forming device, a contact-and-separation device, a thickness information retrieving device, and a controller. The image bearer bears a toner image on a surface of the image bearer. The nip forming device contacts the image bearer to form a transfer nip between the nip forming device and the image bearer and interpose a recording medium therebetween to transfer the toner image from the image bearer onto the recording medium in the transfer nip. The contact-and-separation device moves the image bearer and the nip forming device to contact and separate from each other. The thickness information retrieving device obtains information on a thickness of the recording medium. The controller controls the contact-and-separation device based on the information on the thickness of the recording medium such that in a case in which a thickness of a preceding recording medium and a thickness of a successive recording medium are different in continuous printing in which a plurality of recording media is printed out continuously, the contact-and-separation device adjusts a space between the image bearer and the nip forming device when the preceding recording medium exits the transfer nip to a preset size corresponding to the thickness of the successive recording medium that enters the transfer nip.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein:

FIG. 11 is a table showing relations between cam positions and thickness groups of a preceding sheet and a successive sheet.

DETAILED DESCRIPTION

Figure 1:
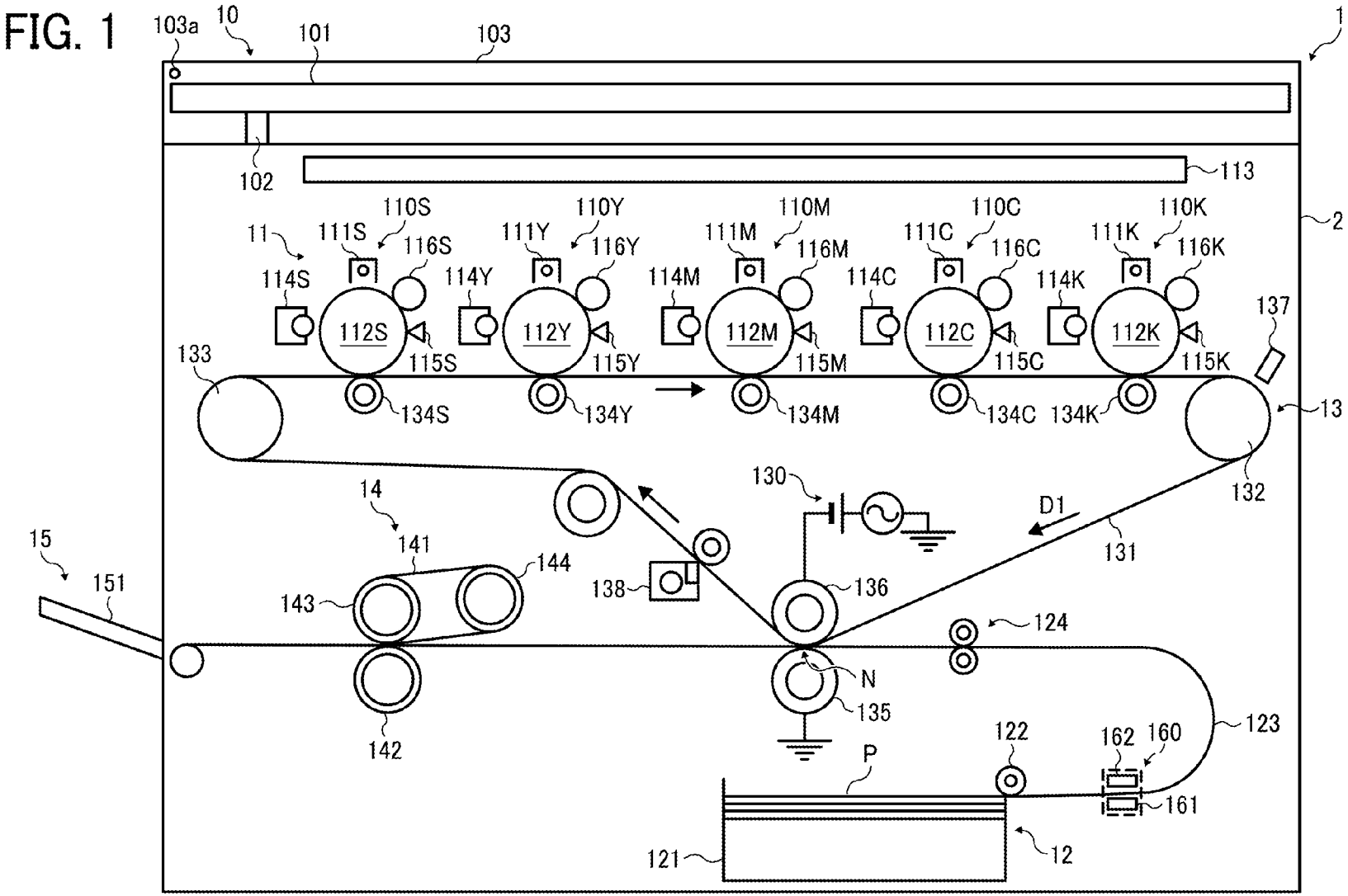
FIG. 1 is a schematic diagram illustrating an image forming apparatus according to an illustrative embodiment of the present disclosure.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, exemplary embodiments of the present disclosure are described.

Figure 3:
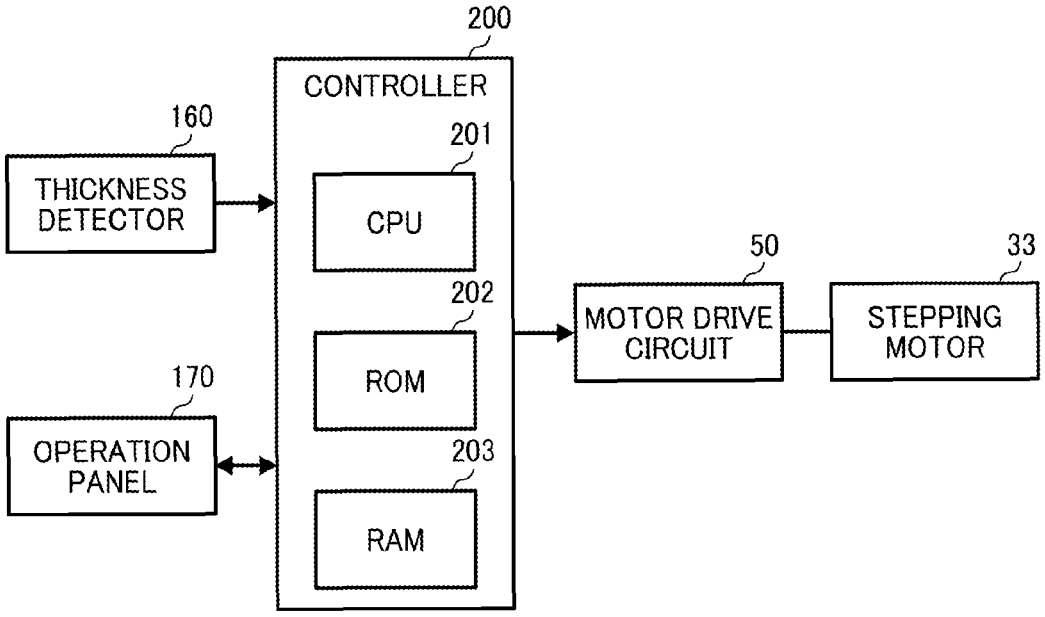
FIG. 3 is a block diagram illustrating a controller employed in the image forming apparatus of FIG. 1 according to an illustrative embodiment of the present disclosure.

FIG. 1 is a schematic diagram illustrating an image forming apparatus 1 according to an illustrative embodiment of the present disclosure. The image forming apparatus 1 illustrated in FIG. 1 is a tandem-type color image forming apparatus in which multiple image forming stations are arranged in tandem. The image forming apparatus 1 includes an image reader 10, an image forming unit 11, a paper feed unit 12, a transfer unit 13, a fixing unit 14, and a paper output unit 15. As illustrated in FIG. 3, the image forming apparatus includes a controller 200.

The image reader 10 includes an exposure glass 101, a reading device 102, a cover 103, a light source, and so forth.

A document is placed on the exposure glass 101. The reading device 102 reads image information of the document on the exposure glass 101 by receiving reflected light reflected upon the document irradiated by the light source. The cover 103 is rotatable about a rotary shaft 103*a* and is openably closable.

In the image reader 10, the cover 103 is opened, allowing the document to be placed on the exposure glass 101. After the cover 103 is closed, the light source of the image reader 10 irradiates the document with light. The reading device 102 consisting of a Charge Coupled Device (CCD), a Contact Image Sensors (CIS), and so forth receives light reflected upon the document, and reads color-separation signals for each of three primary colors of light, i.e., red, green, and blue.

The image forming unit 11 includes image forming stations 110S, 110Y, 110M, 110C, and 110K, one for each of colors, special color, yellow, magenta, cyan, and black, respectively. It is to be noted that the suffixes S, Y, C, M, and K denote the colors, special color, yellow, cyan, magenta, and black, respectively. Special color herein refers to a color that cannot be produced with the toners of yellow, cyan, magenta, and black, for example, a clear toner, metallic, white, and so forth. To simplify the description, the suffixes S, Y, M, C, and K indicating colors are omitted herein unless otherwise specified.

The image forming stations 110S, 110Y, 110M, 110C, and 110K all have the same configuration, differing only in the color of toner employed. The image forming stations 110S, 110Y, 110M, 110C, and 110K employ toners of different colors, that is, special color, yellow, magenta, cyan, and black, respectively. The image forming stations 110S, 110Y, 110M, 110C, and 110K are replaced upon reaching their product life cycles. Each of image forming stations 110S, 110Y, 110M, 110C, and 110K is detachably mountable as a process cartridge relative to a main body 2 of the image forming apparatus.

The image forming stations 110S, 110Y, 110M, 110C, and 110K all have the same configuration, differing only in the color of toner employed. Thus, a description is provided of the image forming station 110K for forming a toner image of black as a representative example of the image forming station. The image forming station 110K includes a charging device 111K, a photoconductor 112K serving as an image bearer or a latent image bearer, a developing device 114K, a static eliminator 115K, a photoconductor cleaner 116K, and so forth. These devices are held in a common holder so that they are detachably attachable together and replaced at the same time.

The photoconductor 112K includes a drum-shaped base on which an organic photosensitive layer is disposed, with the external diameter of approximately 60 mm. The photoconductor 112K is rotated in a counterclockwise direction by a driving device. The charging device 111K includes a charging wire which is a charged electrode of a charger. A charging bias is applied to the charging wire to generate electrical discharge between the charging wire and the outer peripheral surface of the photoconductor 112K. Accordingly, the surface of the photoconductor 112K is uniformly charged.

According to the present illustrative embodiment, the photoconductor 112K is uniformly charged with a negative polarity which is the same polarity as the polarity of normally-charged toner. As a charging bias, an alternating current (AC) voltage superimposed on a direct current (DC) voltage is employed. Alternatively, instead of using the charger, in some embodiments, a charging roller that contacts the photoconductor 112K or is disposed near the photoconductor 112K is employed.

The uniformly charged surface of the photoconductor 112K is scanned by a light beam projected from an exposure device 113, thereby forming an electrostatic latent image for black on the surface of the photoconductor 112K. The potential of the irradiated portion of the photoconductor 112K attenuates and becomes less than the potential of other areas, that is, the background portion (non-image portion), thereby forming the electrostatic latent image on the photoconductor 112K.

The electrostatic latent image for black on the photoconductor 112K is developed with black toner by the developing device 114K. Accordingly, a visible image, also known as a toner image of black, is formed on the photoconductor 112K. As will be described later in detail, the toner image is transferred primarily onto an intermediate transfer belt 131 in a process known as a primary transfer process.

The developing device 114K includes and a container that stores a two-component developing agent including black toner and carrier particles. A developing sleeve disposed inside the container includes a magnetic roller inside the developing sleeve. The magnetic force of the magnetic roller attracts the developing agent onto the surface of the developing sleeve.

A developing bias having the same polarity as that of the toner is applied to the developing sleeve. The developing bias has a potential greater than that of the electrostatic latent image on the photoconductor 112K, but less than the charging potential of the uniformly charged photoconductor 112K. With this configuration, a developing potential that causes the toner on the developing sleeve to move electrostatically to the electrostatic latent image on the photoconductor 112K acts between the developing sleeve and the electrostatic latent image on the photoconductor 112K. A non-developing potential acts between the developing sleeve and the non-image formation area of the photoconductor 112, causing the toner on the developing sleeve to move to the sleeve surface.

Due to the developing potential and the non-developing potential, the toner on the developing sleeve adheres selectively to the electrostatic latent image formed on the photoconductor 112K, thereby forming a visible image, known as a toner image.

The static eliminator 115K removes residual charges on the surface of the photoconductor 112K after the toner image is transferred primarily onto the intermediate transfer belt 131 in the primary transfer process. The photoconductor cleaner 116K includes a cleaning blade and a cleaning brush to remove residual toner remaining on the surface of the photoconductor 112K after the static eliminator 115K removes charges from the surface of the photoconductor 112K.

In FIG. 1, similar to the image forming station 110K, toner images of cyan, magenta, yellow, and special color are formed on the photoconductors 112C, 112M, 112Y, and 112S of the image forming stations 110C, 110M, 110Y, and 110S, respectively. The image forming stations 110C, 110M, 110Y, and 110S include charging devices 111C, 111M, 111Y, and 111S, the developing devices 114C, 114M, 114Y, and 114S, static eliminators 115C, 115M, 115Y, 115Y, and 115S, photoconductor cleaners 116C, 116M, 116Y, and 116S, respectively.

The exposure device 113 serving as a latent image writer or an exposure mechanism is disposed above the image forming stations 110S, 110Y, 110M, 110C, and 110K. Based on image information provided by external devices such as a personal computer (PC), the exposure device 113 illuminates the photoconductors 112S, 112Y, 112M, 112C, and 112K with laser light projected from a light source such as a laser diode of the exposure device 113.

The exposure device 113 includes a polygon mirror, a plurality of optical lenses, and mirrors. The light beam projected from the laser diode serving as a light source is deflected in a main scanning direction by the polygon mirror rotated by a polygon motor. The deflected light, then, strikes the optical lenses and mirrors, thereby irradiating the photoconductors 112S, 112Y, 112M, and 112C. Instead of using laser light, alternatively, the exposure device 113 may employ a plurality of light emitting diodes (LED) to optically write with LED light.

The paper feed unit 12 supplies recording media P to the transfer unit 13. The paper feed unit 12 includes a paper bank 121, a pickup roller 122, a paper delivery path 123, and a pair of registration rollers 124.

The pickup roller 122 rotates and picks up a recording medium P stored in the paper bank 121, and feeds it to the paper delivery path 123. The pickup roller 122 picks up a top sheet of recording media P stored in the paper bank 121 one by one, and feeds it to the paper delivery path 123.

Accordingly, the recording medium P is fed to the paper delivery path 123 by the pickup roller 122 and delivered to the transfer unit 13 by conveyor rollers. Before arriving at the transfer unit 13, the leading end of the recording medium P is interposed between the pair of registration rollers 124, thereby stopping conveyance of the recording medium P temporarily. The pair of registration rollers 124 feeds the recording medium P to a secondary transfer nip N at which the intermediate transfer belt 131 meets a secondary transfer roller 135, in appropriate timing such that the recording medium P is aligned with a toner image formed on the intermediate transfer belt 131.

The transfer unit 13 is disposed substantially below the image forming stations 110S, 110Y, 110M, 110C, and 110K. The transfer unit 13 includes a driving roller 132, a driven roller 133, the intermediate transfer belt 131, primary transfer rollers 134S, 134Y, 134M, 134C, and 134K, the secondary transfer roller 135 rotatable about a rotary shaft 135*a*, a secondary-transfer opposed roller 136 rotatable about a rotary shaft 136*a*, a toner detector 137, a belt cleaning device 138, and so forth.

The intermediate transfer belt 131 is an image bearer made of a belt formed into an endless loop. The intermediate transfer belt 131 is entrained about and stretched taut by the driving roller 132, the driven roller 133, the secondary-transfer opposed roller 136, the primary transfer rollers 134S, 134Y, 134M, 134C, and 134K, and so forth, which are all disposed inside the loop formed by the intermediate transfer belt 131.

The intermediate transfer belt 131 is entrained about these rollers at a certain tension.

The driving roller 132 is driven to rotate clockwise in FIG. 1 by a drive motor, and the rotation of the driving roller 132 enables the intermediate transfer belt 131 to endlessly move clockwise indicated by arrow D1 in FIG. 1 while contacting the photoconductors 112S, 112Y, 112M, 112C, and 112K. A process linear velocity of the intermediate transfer belt 131 is adjusted to approximately 415 mm/sec.

The intermediate transfer belt 131 includes a single layer or multiple layers including, but not limited to, polyimide (PI), polyvinylidene fluoride (PVDF), ethylene tetrafluoroethylene (ETFE), and polycarbonate (PC), with conductive material such as carbon black dispersed therein. The volume resistivity is adjusted to be in a range from $10^8$ [Ωcm] to $10^{12}$ [Ωcm], and the surface resistivity is adjusted to be in a range from $10^9$ Ω/sq and $10^{13}$ Ω/sq.

In some embodiments, the intermediate transfer belt 131 may include a release layer on the surface thereof. In some embodiments, the release layer may include, but is not limited to, fluorocarbon resin such as ETFE, polytetrafluoroethylene (PTFE), PVDF, perfluoroalkoxy polymer resin (PFA), fluorinated ethylene propylene (FEP), and polyvinyl fluoride (PVF). However, the materials for the release layer are not limited thereto.

The intermediate transfer belt 131 is manufactured through a casting process, a centrifugal casting process, and the like. The surface of the intermediate transfer belt 131 may be polished as necessary.

If the volume resistivity of the intermediate transfer belt 131 exceeds the above described range, the bias voltage necessary for the transfer process increases, resulting in an increase in the power and its cost. In the transfer and the sheet stripping process, the electrical potential of the intermediate transfer belt 131 increases, and self discharge becomes difficult. Thus, the static eliminator is necessary.

If the volume resistivity and the surface resistivity are below the above-described range, attenuation of the electrical potential accelerates, which is advantageous in removing charges through self discharge. However, electric current flows in the surface direction upon transfer, causing the toner to scatter.

For the reasons described above, the volume resistivity and the surface resistivity of the intermediate transfer belt 131 need to be within the above described range.

The volume resistivity and the surface resistivity of the intermediate transfer belt 131 are measured as follows. The volume resistivity and the surface resistivity can be measured by connecting an HRS Probe having an inner electrode diameter of 5.9 mm and a ring caliber of 11 mm to a high resistivity meter, Hiresta IP, (Mitsubishi Chemical, Ltd). The volume resistivity is calculated after 10 seconds when a voltage of 100 V (for the surface resistivity, a voltage of 500 V) is applied to both sides of the intermediate transfer belt 131.

According to the illustrative embodiment shown in FIG. 1, the toner detector 137 is disposed opposite to a portion of the intermediate transfer belt 131 entrained about the driving roller 132 with a certain space therebetween.

The primary transfer rollers 134S, 134Y, 134M, 134C, and 134K are disposed opposite the respective photoconductors 112S, 112Y, 112M, 112C, and 112K via the intermediate transfer belt 131, and are rotated to move the intermediate transfer belt 131 in the direction of arrow D1. Accordingly, primary transfer nips are formed between the front surface (image bearing surface) of the intermediate transfer belt 131 and the photoconductors 112S, 112Y, 112M, 112C, and 112K, contacting the intermediate transfer belt 131. Contact herein refers to a state in which an object contacts with or without pressure.

A primary transfer bias is applied to the primary transfer rollers 134S, 134Y, 134M, 134C, and 134K by a primary-transfer bias power source. According to the present illustrative embodiment, a primary transfer bias of +1800 V is applied.

Accordingly, a primary transfer electric field is formed between each of the toner images on the photoconductors 112S, 112Y, 112M, 112C, and 112K, and the primary transfer rollers 134S, 134Y, 134M, 134C, and 134K, respectively. The toner images are transferred onto the intermediate transfer belt 131 such that they are superimposed one atop the other, thereby forming a composite toner image on the intermediate transfer belt 131.

According to the present illustrative embodiment, the image forming apparatus 1 is capable of carrying out four different imaging modes: a full-color mode, a monochrome mode, a special color mode, and a combination mode which is a combination of the full-color mode and the special color mode. According to the present illustrative embodiment, the image forming apparatus 1 includes a primary-transfer contact-and-separation device that moves the primary transfer rollers 134 towards and away from the photoconductors 112, thereby enabling the intermediate transfer belt 131 and the photoconductors 112 to contact and separate from each other.

More specifically, in the full-color mode, a full-color image is formed by the image forming stations 110Y, 110M, 110C, and 110K using toners in yellow, magenta, cyan, and black, respectively.

In the full-color mode, the primary transfer rollers 134Y, 134M, 134C, and 134K are situated near the photoconductors 112Y, 112M, 112C, and 112K, respectively, thereby causing the intermediate transfer belt 131 to contact the photoconductors 112Y, 112M, 112C, and 112K.

In the image forming station 110S which is not used in the full-color mode, the primary transfer roller 134S is situated away from the photoconductor 112S, thereby separating the intermediate transfer belt 131 from the photoconductor 112S.

In the monochrome mode, a monochrome image is formed by the image forming station 110K using a black toner. In the monochrome mode, the primary transfer roller 134K is situated near the photoconductor 112K, causing the intermediate transfer belt 131 to contact the photoconductor 112K.

In the image forming stations 110S, 110Y, 110M, and 110C which are not used in the monochrome mode, the primary transfer rollers 134S, 134Y, 134M, and 134C are situated away from the photoconductors 112S, 112Y, 112M, and 112C, thereby separating the intermediate transfer belt 131 from the photoconductors 112S, 112Y, 112M, and 112C.

In the special color mode, an image is formed by the image forming station 110S using a clear or transparent toner. In the special color mode, the primary transfer roller 134S is situated near the photoconductor 112S, causing the intermediate transfer belt 131 to contact the photoconductor 112S.

In the image forming stations 110Y, 110M, 110C, and 110K which are not used in the special color mode, the primary transfer rollers 134Y, 134M, 134C, and 134K are situated away from the photoconductors 112Y, 112M, 112C, and 112K, thereby separating the intermediate transfer belt 131 from the photoconductors 112Y, 112M, 112C, and 112K.

In the combination mode, an image is formed using all the image forming stations 110S, 110Y, 110M, 110C, and 110K. In combination mode, the primary transfer rollers 134S, 134Y, 134M, 134C, and 134K are situated near the photoconductors 112S, 112Y, 112M, 112C, and 112K, respectively, causing the intermediate transfer belt 131 to contact the photoconductors 112S, 112Y, 112M, 112C, and 112K.

The intermediate transfer belt 131 is interposed between the secondary transfer roller 135 and the secondary-transfer opposed roller 136, and a secondary transfer nip N, at which the front surface or the image bearing surface of the intermediate transfer belt 131 and the secondary transfer roller 135 meet and press against each other, is formed.

The secondary transfer roller 135 is driven to rotate by a driving device. The secondary transfer roller 135 serves as a nip forming device and as a transfer device. The secondary-transfer opposed roller 136 serves as a nip forming device and as an opposed member. The secondary transfer roller 135 is grounded. By contrast, a secondary transfer bias is applied to the secondary-transfer opposed roller 136 by a secondary transfer bias power source 130.

According to the present illustrative embodiment, the secondary transfer bias power source 130 serving as a secondary transfer bias output device includes a direct current (DC) power source and an alternating current (AC) power source, and an alternating current (AC) voltage superimposed on a direct current (DC) voltage is output as the secondary transfer bias. The output terminal of the secondary transfer bias power source 130 is connected to a metal cored bar of the secondary-transfer opposed roller 136. The potential of the metal cored bar of the secondary-transfer opposed roller 136 has a similar or the same value as the output voltage output from the secondary transfer bias power source 130.

By applying the secondary transfer bias to the secondary-transfer opposed roller 136, a secondary transfer electric field is formed between the secondary-transfer opposed roller 136 and the secondary transfer roller 135 so that the toner having a negative polarity is transferred electrostatically from the secondary-transfer opposed roller side to the secondary transfer roller side. With this configuration, the toner having the negative polarity on the intermediate transfer belt 131 is moved from the secondary-transfer opposed roller side to the secondary transfer roller side.

In the secondary transfer bias power source 130, a direct current (DC) component having the same negative polarity as that of the toner is used, and the time-averaged potential of the superimposed bias has the same negative polarity as that of the toner. Alternatively, in some embodiments, the metal cored bar of the secondary-transfer opposed roller 136 is grounded while the superimposed bias is applied to the secondary transfer roller 135. In this case, the polarity of the DC voltage and the DC component is changed.

When using a recording medium P having a coarse surface such as an embossed sheet having a high degree of surface roughness, it is known that application of the superimposed bias can move the toner from the intermediate transfer belt side to the recording medium side while moving the toner back and forth, thereby transferring relatively the toner onto the recording medium P. With this configuration, the transferability of the toner relative to the recessed portions on the recording medium P is enhanced, thus preventing image defects such as toner dropouts and blank spots.

When using a regular sheet of paper or the like, such as the one having a relatively smooth surface, a pattern of dark and light according to the surface conditions of the recording medium P is less likely to appear on the recording medium P. In this case, application of the secondary transfer bias including only the DC component can achieve desired transferability.

The secondary transfer roller 135 is constituted of a metal cored bar made of, for example, stainless steel and aluminum on which a resistance layer and a releasing layer are laminated. Specific preferred materials suitable for the resistance layer include, but are not limited to, polycarbonate, fluorine-based rubber, silicon rubber, and the like in which conductive particles such as carbon and metal complex are dispersed, or rubbers such as nitrile rubber (NBR) and Ethylene Propylene Diene Monomer (EPDM), rubber of NBR/ECO copolymer, and semiconductive rubber such as polyurethane. The volume resistivity of the resistance layer is in a range from $10^6\Omega$ to $10^{12}\Omega$, more preferably, in a range from $10^7\Omega$ to $10^9\Omega$.

The resistance layer may be a foam-type having the hardness in a range of from 20 degrees and 50 degrees or a rubber-type having a hardness in a range of from 30 degrees and 60 degrees on Asker C hardness scale. However, a sponge-type layer is preferred to prevent reliably toner dropouts in character images or thin-line images. Toner dropouts are a partial toner transfer failure in images.

After the intermediate transfer belt 131 passes through the secondary transfer nip N, the residual toner not having been transferred onto the recording medium P remains on the intermediate transfer belt 131. The residual toner is removed from the intermediate transfer belt 131 by a cleaning blade of the belt cleaning device 138 which contacts the surface of the intermediate transfer belt 131.

The fixing unit 14 employs a belt fixing method and includes a fixing belt 141 formed into an endless loop and a pressing roller 142 that is pressed against the fixing belt 141. The fixing belt 141 is entrained about a fixing roller 143 and a heating roller 144. One of the fixing roller 143 and the heating roller 144 includes a heat source such as a heater, a lamp, and an electromagnetic induction type heating device. The fixing belt 141 is interposed between the fixing roller 143 and the pressing roller 142 and pressingly contacts the fixing roller 143, thereby forming a heated area called a fixing nip between the fixing belt 141 and the pressing roller 142.

The recording medium P bearing an unfixed toner image on the surface thereof is delivered to the fixing nip at which the surface of the recording medium P bearing the unfixed toner image tightly contacts the fixing belt 141 in the fixing unit 14. Under heat and pressure in the fixing nip, the toner adhered to the toner image is softened and fixed to the recording medium P.

In the event of duplex printing in which an image is formed on the other side of the recording medium P on which the toner image has been fixed, the recording medium P is delivered to a sheet reversing device in which the recording medium P is reversed after the fixing process. Subsequently, similar to the above-described image forming process, a toner image is formed on the other side of the recording medium P.

The recording medium P on which the toner image is fixed in the fixing unit 14 is output onto an output tray 151 from the main body 2 of the image forming apparatus 1 via output rollers of a paper output unit 15.

Figure 2:
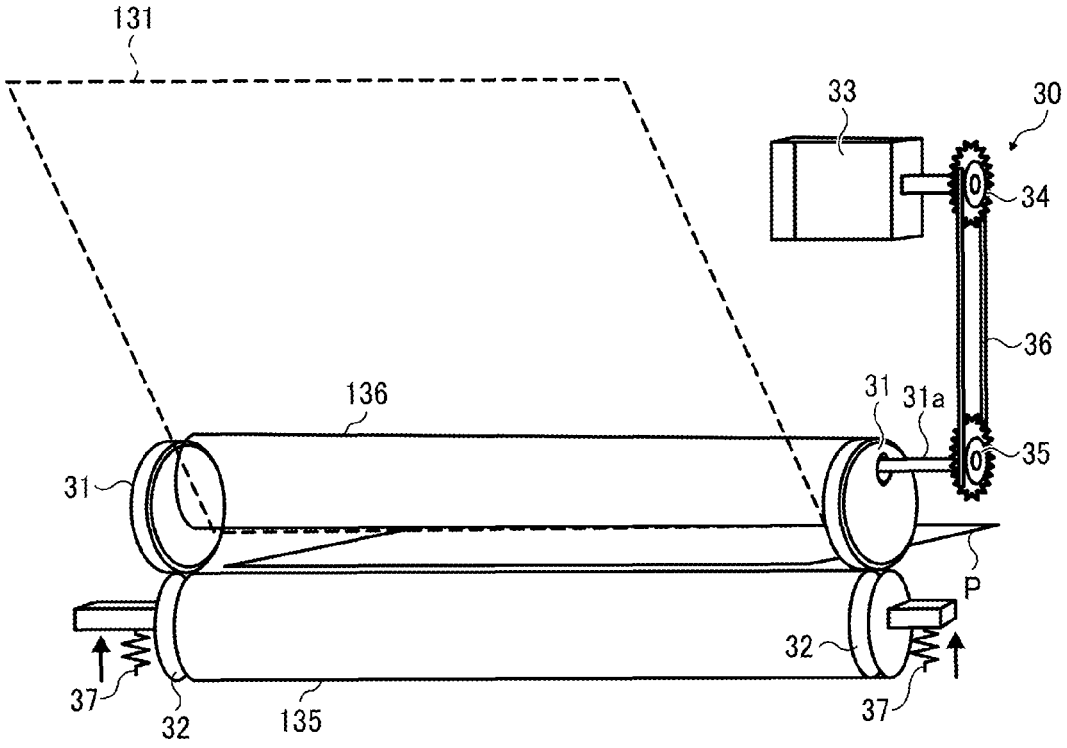
FIG. 2 is a schematic diagram illustrating a contact-and-separation device that moves an intermediate transfer belt and a secondary transfer roller to contact and separate from each other.

Referring now to FIG. 2, there is provided a schematic diagram illustrating a contact-and-separation device 30 that moves the intermediate transfer belt 131 and the secondary transfer roller 135 to contact and separate from each other. The secondary transfer roller 135 is disposed below the secondary-transfer opposed roller 136 via the intermediate transfer belt 131. The secondary transfer roller 135 is pressed by a biasing member such as a spring 37 against the secondary-transfer opposed roller 136.

The spring 37 includes, but is not limited to, a compression spring and a tension spring. The spring 37 presses the secondary transfer roller 135 to apply a predetermined transfer pressure to a recording medium P and the intermediate transfer belt 131.

The contact-and-separation device 30 includes a stepping motor 33 and eccentric cams 31. The contact-and-separation device 30 moves the intermediate transfer belt 131 and the secondary transfer roller 135 to contact and separate from each other freely within a certain range. The eccentric cam 31 is disposed at both ends of the secondary-transfer opposed roller 136 in an axial direction of the secondary-transfer opposed roller 136, coaxially on the same shaft as the secondary-transfer opposed roller 136.

A ball bearing 32 is disposed at both ends of the secondary transfer roller 135 in an axial direction of the secondary transfer roller 135 in such a manner that the ball bearing 32 does not interfere with rotation of the secondary transfer roller 135. The ball bearing 32 contacts the eccentric cam 31. The eccentric cam 31 is fitted to a groove (e.g., D-cut groove) or the like formed in a cam shaft 31*a* such that as the cam shaft 31*a* with the eccentric cam 31 attached thereto is rotated by a rotary driving force from the stepping motor 33 the eccentric cam 31 rotates at the same timing and at the same angle.

The eccentric cam 31 has such a shape that the shortest distance from the center of rotation of the eccentric cam 31 to the periphery of the eccentric cam 31 is shorter than the diameter of the secondary-transfer opposed roller 136. Furthermore, the longest distance from the center of rotation of the eccentric cam 31 to the periphery of the eccentric cam 31 is longer than the diameter of the secondary-transfer opposed roller 136.

Rotation of the cam shaft 31*a* is controlled freely by the stepping motor 33, and the rotary driving force of the stepping motor 33 is transmitted to the cam shaft 31*a* via gears 34 and 35, and a timing belt 36. The stepping motor 33 is capable of rotation control with a 1.8° step angle. Before the recording medium P enters the secondary transfer nip N, the rotary driving force from the stepping motor 33 rotates the eccentric cam 31.

As described above, the eccentric cam 31 contacts the ball bearing 32. When the eccentric cam 31 is rotated, the following relation is satisfied: L1>L2, where L1 is a sum of a distance from the center of rotation of the eccentric cam 31 to a contact portion of the eccentric cam 31 contacting the ball bearing 32 and a radius of the ball bearing 32, and L2 is a sum of the radius of the secondary-transfer opposed roller 136, the thickness of the intermediate transfer belt 131, and the radius of the secondary transfer roller 135. In this configuration, the secondary transfer roller 135 is pushed down against the pressure of the spring 37 in a direction in which the secondary transfer roller 135 separates from the intermediate transfer belt 131.

Subsequently, when the leading end of the recording medium starts to pass between the intermediate transfer belt 131 and the secondary transfer roller 135, the eccentric cam 31 is rotated by the stepping motor 33 again. With the relation L1<L2 satisfied, the intermediate transfer belt 131 and the secondary transfer roller 135 contact each other, thereby applying a predetermined transfer pressure to the recording medium P.

With this configuration, when the recording medium enters the secondary transfer nip N, the intermediate transfer belt 131 and the secondary transfer roller 135 are separated from each other, thereby preventing impact of the recording medium P upon entering the secondary transfer nip N and changes in the process linear velocity (traveling speed) of the intermediate transfer belt 131.

According to the present illustrative embodiment, in the contact-and-separation device 30 shown in FIG. 2, the eccentric cam 31 is disposed on the secondary-transfer opposed roller 136, and the ball bearing 32 is disposed on the secondary transfer roller 135. Alternatively, in some embodiments, the eccentric cam 31 may be disposed on the secondary transfer roller 135, and the ball bearing 32 is disposed on the secondary-transfer opposed roller 136. That is, the eccentric cam 31 is disposed coaxially on both ends of the shaft of the secondary transfer roller 135 in the axial direction thereof, and the ball bearing 32 is disposed coaxially on both ends of the secondary-transfer opposed roller 136 in the axial direction thereof in such a manner that the eccentric cams 31 contact the ball bearings 32.

FIG. 3 is a block diagram illustrating a controller 200 of the image forming apparatus 1 according to an illustrative embodiment of the present disclosure.

The image forming apparatus 1 includes the controller 200 that controls various operations including an image reading operation and an image forming operation. The controller 200 includes a central processing unit (CPU) 201 to run control programs, a Read Only Memory (ROM) 202 to store the control programs, and a Random Access Memory (RAM) 203 to allow the control programs to be read and to temporarily store data.

A motor drive circuit 50 to control the stepping motor 33, a thickness detector 160, an operation panel 170, and so forth are connected to the controller 200. The thickness detector 160 serves as a thickness information retrieving device to obtain information on the thickness of the recording medium P.

Based on the relations of information on the thickness of the recording medium P obtained from the thickness detector 160 and the operation panel 170 and the space between the secondary transfer roller 135 and the secondary-transfer opposed roller 136, the controller 200 controls the stepping motor 33 via the motor drive circuit 50. Accordingly, the controller 200 controls rotation of the eccentric cam 31.

Figure 4:
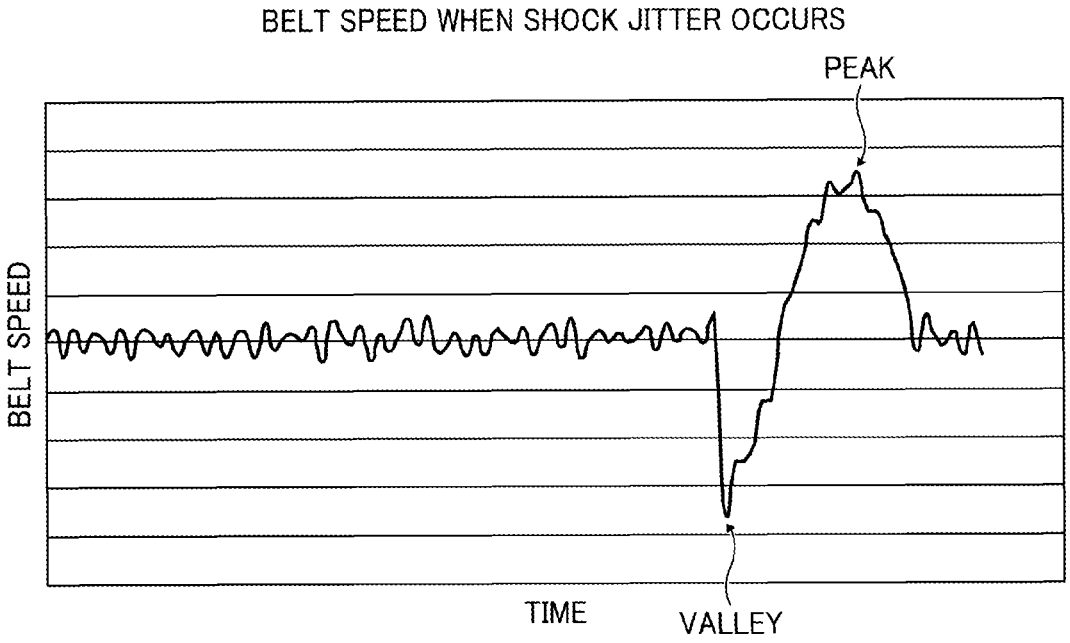
FIG. 4 is a graph showing fluctuations in a process linear velocity of the intermediate transfer belt.

FIG. 4 is a graph showing fluctuations in the process linear velocity of the intermediate transfer belt 131. Normally, the intermediate transfer belt 131 travels at a constant process linear velocity within a certain range around a preset process linear velocity. However, when the recording medium P enters the secondary transfer nip N and when the intermediate transfer belt 131 and the secondary transfer roller 135 that are separated come in contact with each other, the impact thus produced and load on the torque cause the process linear velocity of the intermediate transfer belt 131 to slow down such as shown at the valley portion of the graph in FIG. 4.

Subsequently, after the recording medium P exits the secondary transfer nip N, the recording medium P no longer causes the load on the torque. Therefore, the process linear velocity of the intermediate transfer belt 131 gets accelerated such as shown at the peak portion of the graph in FIG. 4. If the impact on the secondary transfer nip N is large when the recording medium P enters the secondary transfer nip N, the deceleration ratio of the intermediate transfer belt 131 becomes large, and hence the dip of the valley portion in the graph in FIG. 4 becomes large. As a result, undesirable streaking (horizontal streaking) or a so-called shock jitter appears in halftone images.

Figure 5:
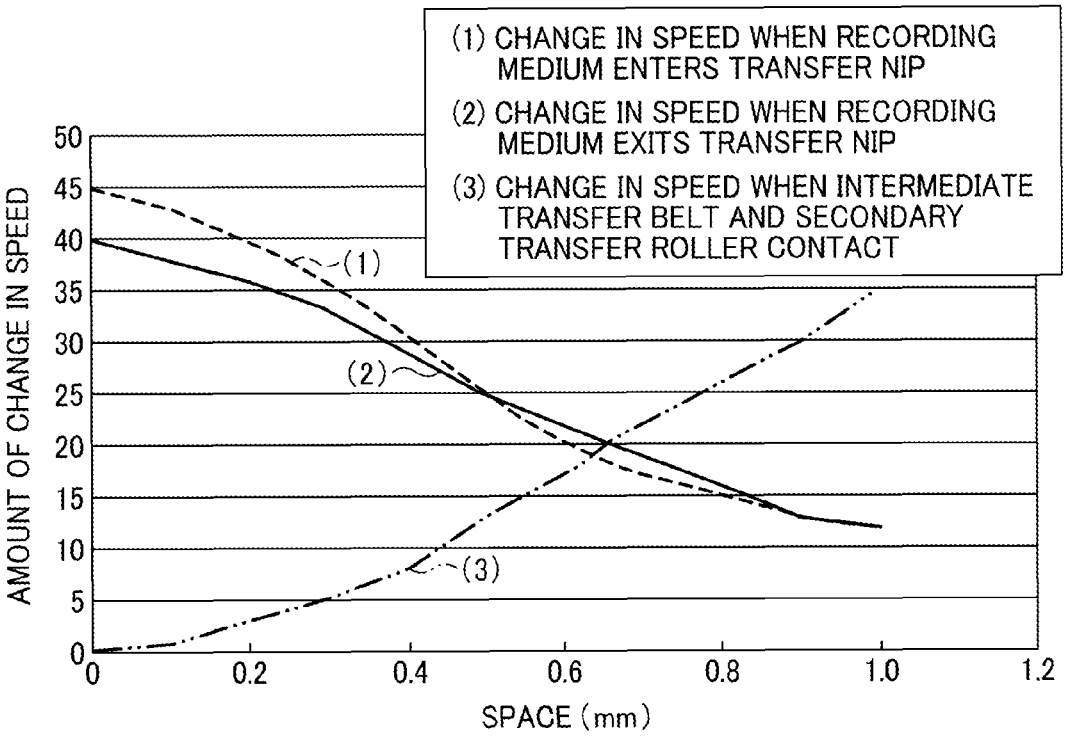
FIG. 5 is a graph showing relations between a space between the intermediate transfer belt and the secondary transfer roller, and the process linear velocity of the intermediate transfer belt.

FIG. 5 is a graph showing relations between a space between the intermediate transfer belt 131 and the secondary transfer roller 135, and changes in the process linear velocity of the intermediate transfer belt 131. In FIG. 5, (1) represents changes in the process linear velocity when the recording medium P enters the secondary transfer nip N. In FIG. 5, (2) represents changes in the process linear velocity when the recording medium P exits the secondary transfer nip N. (3) represents changes in the process linear velocity when the intermediate transfer belt 131 and the secondary transfer roller 135 that are separated come in contact each other.

In FIG. 5, the vertical axis of the graph represents an amount of change in the process linear velocity of the intermediate transfer belt 131, and shows the absolute value at its maximum indicating how much the speed has changed from an average process linear velocity. In FIG. 5, the horizontal axis of the graph represents an amount of space between the intermediate transfer belt 131 and the secondary transfer roller 135 when the intermediate transfer belt 131 and the secondary transfer roller 135 are separated from each other.

The larger is the space, the smaller is the impact when the recording medium P enters the secondary transfer nip N. Accordingly, the larger is the space, the smaller is the amount by which the process linear velocity changes when the recording medium P enters the secondary transfer nip N.

By contrast, the larger is the space, the greater is the impact generated when the intermediate transfer belt 131 and the secondary transfer roller 135 that are separated come in contact with each other again. Therefore, the larger is the space, the larger is the amount by which the process linear velocity changes when the intermediate transfer belt 131 and the secondary transfer roller 135 that are separated come in contact again.

In view of the above, the intermediate transfer belt 131 and the secondary transfer roller 135 are spaced apart such that the sum of the amount of change in the process linear velocity when the recording medium P enters the secondary transfer nip N and the amount of change in the process linear velocity when the intermediate transfer belt 131 and the secondary transfer roller 135 that are separated come in contact with each other is the smallest. With this configuration, changes in the process linear velocity can be minimized when the recording medium P enters the secondary transfer nip N, hence reducing the shock jitter. Thereafter, the space between the intermediate transfer belt 131 and the secondary transfer roller 135 that can minimize the changes in the process linear velocity when the recording medium P enters the secondary transfer nip N is referred to as a width W2.

Furthermore, the larger is the space, the smaller is the impact when the recording medium P exits the secondary transfer nip N. Accordingly, the larger is the space, the smaller is the amount by which the process linear velocity changes when the recording medium P exits the secondary transfer nip N.

When the recording medium P exits the secondary transfer nip N, the intermediate transfer belt 131 and the secondary transfer roller 135 separate from each other, but the impact thus produced is insignificant and does not influence the quality of an output image. In view of the above, the space is set to be as large as possible when the recording medium P exits the secondary transfer nip N. With this configuration, changes in the process linear velocity can be minimized when the recording medium P exits the secondary transfer nip N, hence reducing the shock jitter. Thereafter, the space between the intermediate transfer belt 131 and the secondary transfer roller 135 that can minimize the changes in the process linear velocity when the recording medium P exits the secondary transfer nip N is referred to as a width W1.

As described above, when the recording medium P enters the secondary transfer nip N, the space has the width W2. When the recording medium P exits the secondary transfer nip N, the space has the width W1. This configuration minimizes or prevents the shock jitter, hence achieving good imaging quality.

Figure 6:
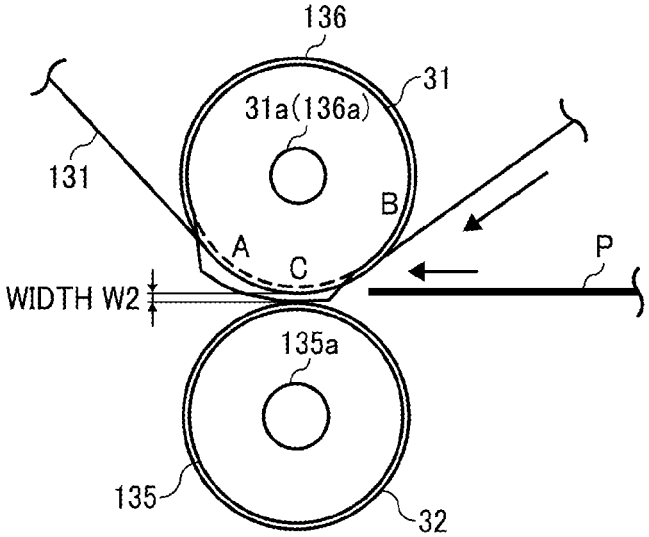
FIG. 6 is a schematic diagram illustrating the intermediate transfer belt and the secondary transfer roller spaced apart at a width W2.
Figure 7:
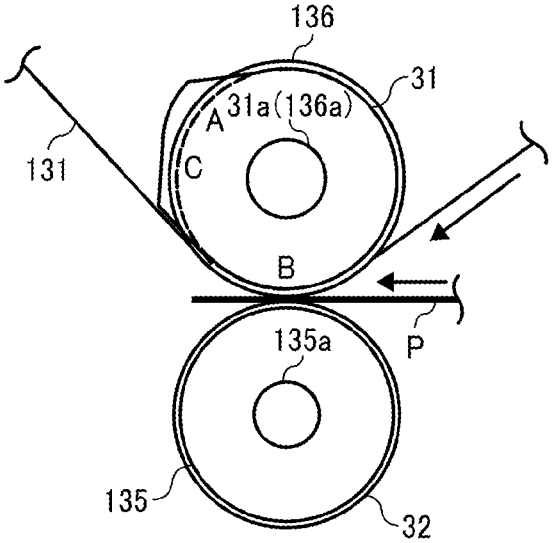
FIG. 7 is a schematic diagram illustrating the intermediate transfer belt and the secondary transfer roller contacting each other.
Figure 8:
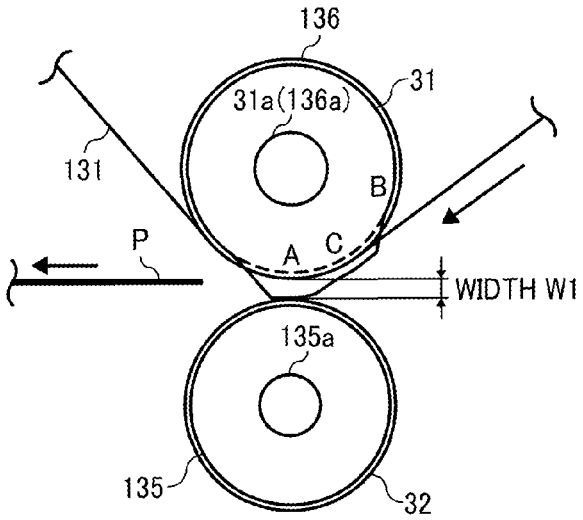
FIG. 8 is a schematic diagram illustrating the intermediate transfer belt and the secondary transfer roller spaced apart at a width W1.

With reference to FIGS. 6 through 8, a description is provided of contact and separation movement of the intermediate transfer belt 131 and the secondary transfer roller 135. FIG. 8 is a schematic diagram illustrating the intermediate transfer belt 131 and the secondary transfer roller 135 spaced apart at the width W1. FIG. 7 is a schematic diagram illustrating the intermediate transfer belt 131 and the secondary transfer roller 135 contacting each other. FIG. 6 is a schematic diagram illustrating the intermediate transfer belt 131 and the secondary transfer roller 135 spaced apart at the width W2.

FIG. 6 illustrates the eccentric cam 31 immediately before the recording medium P enters the secondary transfer nip N. FIG. 7 illustrates the eccentric cam 31 during the transfer process in which the toner image is transferred from the intermediate transfer belt 131 onto the recording medium P. FIG. 8 illustrates the eccentric cam 31 just as the recording medium P exits the secondary transfer nip N.

There are three stop positions for the eccentric cam 31, that is, a cam position A, a cam position B, and a cam position C, at which the eccentric cam 31 stops. As illustrated in FIG. 8, when the eccentric cam 31 stops at the cam position A, the intermediate transfer belt 131 and the secondary transfer roller 135 are spaced apart at the width W1.

As illustrated in FIG. 6, when the eccentric cam 31 stops at the cam position C, the intermediate transfer belt 131 and the secondary transfer roller 135 are spaced apart at the width W2.

As illustrated in FIG. 7, when the eccentric cam 31 stops at the cam position B, the following relation is satisfied:

(Radius of the eccentric cam 31 from the center of rotation to the periphery at the cam position *B*+Radius of the ball bearing 32)<(Radius of the secondary-transfer opposed roller 136+ Thickness of the intermediate transfer belt 131+ Radius of the secondary transfer roller 135)

In this configuration, the intermediate transfer belt 131 and the secondary transfer roller 135 are in contact with each other. As described above, the spring 37 applies a necessary transfer pressure to the secondary transfer roller 135 to transfer the toner image from the intermediate transfer belt 131 onto the recording medium P.

The eccentric cam 31 is rotated about the cam shaft 31*a* by a rotary driving force transmitted from the stepping motor 33 controlled by the controller 200, thereby enabling the eccentric cam 31 to stop at different positions consecutively in the order of the cam position C, the cam position B, the cam position A, and the cam position C. Alternatively, the eccentric cam 31 has such a shape that allows the eccentric cam 31 to change its positions in the order of the cam position C, the cam position A, the cam position B, the cam position C, the cam position A, and the cam position B while making one rotation.

Before the recording medium P enters the secondary transfer nip N, the controller 200 controls the stepping motor 33 to stop the eccentric cam 31 to stop at the cam position C as illustrated in FIG. 6. Accordingly, the intermediate transfer belt 131 and the secondary transfer roller 135 are spaced apart at the width W2, letting the recording medium P to enter the secondary transfer nip N.

After the recording medium P enters the secondary transfer nip N, the eccentric cam 31 is moved from the cam position C to the cam position B while the margin of the recording medium P passes through the secondary transfer nip N so that the intermediate transfer belt 131 and the secondary transfer roller 135 to come in contact with each other.

In this configuration, the intermediate transfer belt 131 and the secondary transfer roller 135 are spaced apart at the width W2 such that the sum of the impact when the recording medium P enters the secondary transfer nip N and the impact when the intermediate transfer belt 131 and the secondary transfer roller 135 that are separated come in contact with each other is the smallest. With this configuration, the shock jitter is minimized when the recording medium P enters the secondary transfer nip N.

During the transfer process in which the toner image is transferred from the intermediate transfer belt 131 to the recording medium P, as illustrated in FIG. 7, the eccentric cam 31 is stopped at the cam position B, and the recording medium P is interposed between the intermediate transfer belt 131 and the secondary transfer roller 135. Accordingly, an adequate transfer pressure can be applied to transfer the toner image from the intermediate transfer belt 131 to the recording medium P.

Subsequently, after the toner image is transferred from the intermediate transfer belt 131 onto the recording medium P, but before the trailing edge of the recording medium P exits the secondary transfer nip N, the controller 200 controls the stepping motor 33 to move the eccentric cam 31 from the cam position B to the cam position A. With this configuration, the eccentric cam 31 is stopped at the cam position A as illustrated in FIG. 8, thereby separating the intermediate transfer belt 131 and the secondary transfer roller 135 at the width W1 in preparation for the trailing edge of the recording medium P to exit the secondary transfer nip.

The intermediate transfer belt 131 and the secondary transfer roller 135 are spaced apart at the width W1 when the trailing edge of the recording medium P exits the secondary transfer nip N, thereby minimizing the impact when the trailing edge of the recording medium P exits the secondary transfer nip N. With this configuration, the shock jitter is minimized when the recording medium P exits the secondary transfer nip N.

Subsequently, after the trailing edge of the recording medium P exits the secondary transfer nip N, the controller 200 controls the stepping motor 33 to move the eccentric cam 31 from the cam position A to the cam position C. With this configuration, the toner image is transferred onto the successive recording medium P (the second sheet of the recording medium P) while the intermediate transfer belt 131 and the secondary transfer roller 135 are spaced apart at such a distance that the impact is minimized when the successive recording medium P (the second sheet of the recording medium P) enters the secondary transfer nip N.

The eccentric cam 31 is rotated as described above when the toner image is transferred from the intermediate transfer belt 131 onto the recording medium P. With this configuration, all the impact such as the impact of the recording medium P entering and exiting the secondary transfer nip N and the impact produced by the secondary transfer roller 135 and the intermediate transfer belt 131 coming in contact with each other after being separated can be minimized, hence reducing the shock jitter and hence achieving good imaging quality.

Rotation control of the eccentric cam 31 as described with reference to FIGS. 6 through 8 is most effective, that is, the shock jitter can improve most effectively when the recording medium P is relatively thin and the impact caused by the intermediate transfer belt 131 and the secondary transfer roller 135 contacting each other is significant. By contrast, in a case in which the recording medium P is relatively thick, the impact caused by the recording medium P entering the secondary transfer nip N is more significant than the impact caused by the intermediate transfer belt 131 and the secondary transfer roller 135 coming into contact with each other.

In view of the above, when the recording medium P is relatively thick and enters the secondary transfer nip N, the intermediate transfer belt 131 and the secondary transfer roller 135 are spaced apart at the width W1, thereby widening the space therebetween. With this configuration, the impact is reduced significantly when the recording medium P enters the secondary transfer nip N, and the shock jitter is minimized.

A description is provided of rotation control of the eccentric cam 31 when the recording medium P is relatively thick. Before the recording medium P enters the secondary transfer nip N, the controller 200 causes the stepping motor 33 to stop the eccentric cam 31 at the cam position A to make the space between the intermediate transfer belt 131 and the secondary transfer roller 135 to have the width W1. Then, the recording medium P is introduced to the secondary transfer nip N.

After the recording medium P enters the secondary transfer nip N, the controller 200 causes the stepping motor 33 to move the eccentric cam 31 from the cam position A to the cam position B while the margin of the recording medium P passes through the secondary transfer nip N, and the eccentric cam 31 is stopped at the cam position B. During the transfer process in which the toner image is transferred from the intermediate transfer belt 131 to the recording medium P, the recording medium P is interposed between the intermediate transfer belt 131 and the secondary transfer roller 135.

Subsequently, after the toner image is transferred from the intermediate transfer belt 131 onto the recording medium P, but before the trailing edge of the recording medium P exits the secondary transfer nip N, the controller 200 causes the stepping motor 33 to move the eccentric cam 31 from the cam position B to the cam position A. With this configuration, when the recording medium P exits the secondary transfer nip N, the eccentric cam 31 is stopped at the cam position A, thereby making the space to have the width W1.

Alternatively, in some embodiments, the eccentric cam 31 is rotated based on relations between the thickness of the recording medium P and a threshold associated with different thicknesses of the recording medium P.

More specifically, in one example, in a case in which the thickness (thickness $T_A$) of the recording medium P is smaller than a threshold $Q_A$, the impact caused by the recording medium P entering the secondary transfer nip N and the impact caused by the recording medium P exiting the secondary transfer nip N are insignificant. Therefore, when the recording medium P enters the secondary transfer nip N and when the recording medium P exits the secondary transfer nip N, the intermediate transfer belt 131 and the secondary transfer roller 135 are not separated from each other.

In another example, in a case in which the thickness (thickness $T_B$) of the recording medium P is greater than the threshold $Q_A$ and less than a threshold $Q_B$ (thickness $T_B$), the impact caused by the intermediate transfer belt 131 and the secondary transfer roller 135 coming in contact with each other after being separated is greater than the impact caused by the recording medium P entering the secondary transfer nip N. Therefore, when the recording medium P enters the secondary transfer nip N, the space is reduced so as to reduce the subsequent impact caused by the intermediate transfer belt 131 and the secondary transfer roller 135 coming in contact with each other.

By contrast, the impact caused by the recording medium P exiting the secondary transfer nip N is greater than the impact caused by the intermediate transfer belt 131 and the secondary transfer roller 135 separating from each other. In view of the above, the width of the space is increased when the recording medium P exits the secondary transfer nip N, thereby reducing the impact when the recording medium P exits the secondary transfer nip N.

In another example, in a case in which the thickness (thickness $T_C$ of the recording medium P is greater than the threshold $Q_B$, the impact caused by the recording medium P entering the secondary transfer nip N is greater than the impact caused by the intermediate transfer belt 131 and the secondary transfer roller 135 coming in contact with each other after being separated. In view of the above, the size of the space is increased when the recording medium P enters the secondary transfer nip N, thereby reducing the impact when the recording medium P enters the secondary transfer nip N.

Furthermore, the impact caused by the recording medium P exiting the secondary transfer nip N is greater than the impact caused by the intermediate transfer belt 131 and the secondary transfer roller 135 coming in contact with each other after being separated. In view of the above, the width of the space is increased when the recording medium P exits the secondary transfer nip N, thereby reducing the impact when the recording medium P exits the secondary transfer nip N.

As described above, rotation of the eccentric cam 31 is adjusted at three different positions in accordance with the thickness of the recording medium P to reduce the shock jitter irrespective of the thickness of the recording medium P. Accordingly, good imaging quality is achieved.

According to the present illustrative embodiment, the image forming apparatus 1 includes the thickness detector 160 on the paper delivery path 123 from the paper feed unit 12 to the secondary transfer nip N. The thickness detector 160 serves as a paper thickness detector to detect the thickness of the recording medium P. Based on the result provided by the thickness detector 160, the controller 200 determines the size of the space between the intermediate transfer belt 131 and the secondary transfer roller 135 when the recording medium P enters the secondary transfer nip N and when the recording medium P exits the secondary transfer nip N, and controls the contact-and-separation device 30.

The thickness detector 160 is a through-beam type optical detector including a light emitting element 161 and a light receiving element 162 disposed opposite the light emitting element 161 via the paper delivery path 123. The light receiving element 162 receives light irradiated by the light emitting element 161 and penetrating through the recording medium P. A signal corresponding to the intensity of the received light is output as information associated with the thickness of the recording medium P to the controller 200. It is to be noted that the thickness detector is not limited to a through-beam type optical detector. Any other suitable detector that can detect the thickness of the recording medium P can be used.

The operation panel 170 (shown in FIG. 3) of the image forming apparatus 1 may function as an input device through which users can input information on the thickness of the recording medium P. Based on the input information provided by the users using the operation panel 170, the controller 200 determines the width of the space between the intermediate transfer belt 131 and the secondary transfer roller 135 when the recording medium P enters the secondary transfer nip N and when the recording medium P exits the secondary transfer nip N, and controls the contact-and-separation device 30.

Table 1 shows relations of a thickness group, a paper thickness (basis weight), and a size of the space (SPACE 1) when the recording medium P enters the secondary transfer nip N and a size of the space (SPACE 2) when the recording medium P exits the secondary transfer nip N.

TABLE 1

| THICKNESS GROUP | α | β | γ | Z |
|---|---|---|---|---|
| THICKNESS (gsm) | 0~90 | 91~157 | 158~220 | 221~400 |
| SPACE 1 | NONE | SMALL | SMALL | LARGE |
| SPACE 2 | NONE | SMALL | LARGE | LARGE |

A thickness group α is a recording medium P having a basis weight in a range from 0 gsm to 90.0 gsm. The recording medium P in the thickness group α is very thin and produces very small impact when the recording medium P enters the secondary transfer nip N and when the recording medium P exits the secondary transfer nip N.

Thus, the impact that is produced when the intermediate transfer belt 131 and the secondary transfer roller 135 come in contact with each other and when the intermediate transfer belt 131 and the secondary transfer roller 135 separate from each other is translated into the shock jitter. Therefore, when using the recording medium P belonging to the thickness group α for printing, the intermediate transfer belt 131 and the secondary transfer roller 135 are not moved to contact and separate from each other when the recording medium P enters the secondary transfer nip N and when the recording medium P exits the secondary transfer nip N.

A thickness group β is a recording medium P having a basis weight in a range from 90.1 gsm to 157.0 gsm. The recording medium P in the thickness group β is relatively thin and produces small impact when the recording medium P enters the secondary transfer nip N and when the recording medium P exits the secondary transfer nip N. Although the impact is small, the impact is greater than the impact produced by the recording medium P in the thickness group α. Therefore, when using the recording medium P in the thickness group β for printing, the intermediate transfer belt 131 and the secondary transfer roller 135 are slightly separated from each other when the recording medium P enters the secondary transfer nip N and when the recording medium P exits the secondary transfer nip N, thereby reducing the impact.

Since the recording medium P in the thickness group β is also thin, the impact that is produced when the intermediate transfer belt 131 and the secondary transfer roller 135 come in contact with each other and when the intermediate transfer belt 131 and the secondary transfer roller 135 separate from each other is translated into the shock jitter. Consequently, the intermediate transfer belt 131 and the secondary transfer roller 135 are not separated by a large amount.

A thickness group γ is a recording medium P having a basis weight in a range from 157.1 gsm to 220.0 gsm. The recording medium P in the thickness group γ is relatively thick and produces greater impact than the recording medium P in the thickness group β when the recording medium P enters the secondary transfer nip N and when the recording medium P exits the secondary transfer nip N. Therefore, when using the recording medium P in the thickness group γ for printing, the intermediate transfer belt 131 and the secondary transfer roller 135 are separated from each other when the recording medium P enters the secondary transfer nip N and when the recording medium P exits the secondary transfer nip N, thereby reducing the impact.

However, the impact that is produced when the intermediate transfer belt 131 and the secondary transfer roller 135 come in contact with each other and when the intermediate transfer belt 131 and the secondary transfer roller 135 separate from each other is translated into the shock jitter. For this reason, the width of the space is relatively small when the recording medium P enters the secondary transfer nip N.

The impact caused by the intermediate transfer belt 131 and the secondary transfer roller 135 separating from each other is smaller than the impact caused by the recording medium P exiting the secondary transfer nip N. Therefore, when using the recording medium P in the thickness group γ for printing, the intermediate transfer belt 131 and the secondary transfer roller 135 are separated from each other by a large amount when the recording medium P exits the secondary transfer nip N.

A thickness group Z is a recording medium P having a basis weight in a range from 220.1 gsm to 400.0 gsm. The recording medium P in the thickness group Z is very thick and produces significant impact when the recording medium P enters the secondary transfer nip N and when the recording medium P exits the secondary transfer nip N. Therefore, when using the recording medium P in the thickness group Z for printing, the intermediate transfer belt 131 and the secondary transfer roller 135 are separated from each other by a large amount when the recording medium P enters the secondary transfer nip N as well as when the recording medium P exits the secondary transfer nip N.

Figure 9:
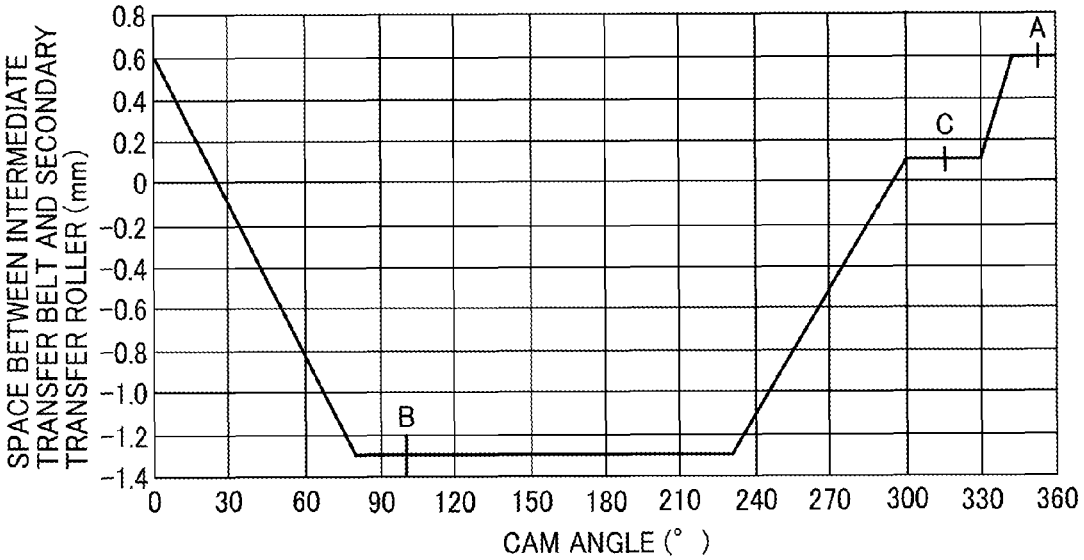
FIG. 9 is a graph showing relations between a shape of eccentric cam and a cam diagram.

FIG. 9 is a diagram for explaining the shape of the eccentric cam 31 and the cam diagram of the eccentric cam 31. With reference to FIG. 9, when the intermediate transfer belt 131 and the secondary transfer roller 135 contact each other without deformation of the elastic layer of the secondary transfer roller 135, the distance between the intermediate transfer belt 131 and the secondary transfer roller 135 is zero (0).

As described above, the eccentric cam 31 has three different cam positions: the cam position A, the cam position B, and the cam position C. The eccentric cam 31 is rotated about the cam shaft 31*a* by the rotary driving force transmitted from the stepping motor 33 (shown in FIG. 2) controlled by the controller 200, thereby enabling the eccentric cam 31 to stop at different cam positions.

When the eccentric cam 31 is at the cam position A, the eccentric cam 31 pushes down the ball bearing 32 disposed coaxially on the same shaft as the secondary transfer roller 135, thereby making the distance between the intermediate transfer belt 131 and the secondary transfer roller 135 approximately 0.6 mm. Accordingly, the intermediate transfer belt 131 and the secondary transfer roller 135 are separated completely.

When the eccentric cam 31 is at the cam position B, the eccentric cam 31 is separated from the ball bearing 32 completely, and the intermediate transfer belt 131 and the secondary transfer roller 135 are in contact with each other completely. Accordingly, an adequate transfer pressure can be applied during the transfer process, thereby obtaining good imaging quality.

Furthermore, when the eccentric cam 31 is at the cam position B, the secondary transfer roller 135 is pressed against the secondary-transfer opposed roller 136 via the intermediate transfer belt 131, and the elastic layer of the secondary transfer roller 135 is squashed or deformed elastically. Therefore, when the eccentric cam 31 is at the cam position B, the distance between the intermediate transfer belt 131 and the secondary transfer roller 135 has a negative value in accordance with deformation of the elastic layer of the secondary transfer roller 135.

When the eccentric cam 31 is at the cam position C, the eccentric cam 31 pushes down slightly the ball bearing 32, thereby making the distance between the intermediate transfer belt 131 and the secondary transfer roller 135 approximately 0.1 mm. Alternatively, when the eccentric cam 31 is at the cam position C, the intermediate transfer belt 131 and the secondary transfer roller 135 may contact each other slightly so that the transfer pressure is reduced.

By changing the cam position of the eccentric cam 31 by the stepping motor 33 or the like, the desired distance between the intermediate transfer belt 131 and the secondary transfer roller 135 can be achieved.

Table 2 shows relations of the thickness group and the cam position of the eccentric cam 31 at different timing, i.e., when the recording medium P enters the secondary transfer nip N, during the transfer process, and when the recording medium P exits the secondary transfer nip N.

TABLE 2

| THICKNESS GROUP | α | β | γ | Z |
|---|---|---|---|---|
| UPON SHEET ENTRY | B | C | C | A |
| DURING PRINTING | B | B | B | B |
| UPON SHEET EXIT | B | C | C | A |

In order to achieve the same or similar relations between the thickness groups, i.e., the thickness groups α, β, γ, and Z, and the space between the intermediate transfer belt 131 and the secondary transfer roller 135 by rotating the eccentric cam 31 such as shown in Table 1, it is necessary to situate the eccentric cam 31 at the respective cam positions shown in Table 2, at times i.e., when the recording medium P enters the secondary transfer nip N, during the transfer process, and when the recording medium exits the secondary transfer nip N.

For example, in a case in which the recording media P of the thickness group Z are printed out continuously, when the recording medium P enters the secondary transfer nip N, the eccentric cam 31 is moved to the cam position A. During the transfer process, it is necessary to move the eccentric cam 31 to the cam position B. When the recording medium P exits the secondary transfer nip N, it is necessary to move the eccentric cam 31 back to the cam position A.

By the time a toner image is transferred onto the successive recording medium P of the thickness group Z in the secondary transfer nip N, the eccentric cam 31 stands by at the cam position A. Thus, the cam position of the eccentric cam 31 when the preceding recording medium P exits the secondary transfer nip N coincides with the cam position of the eccentric cam 31 when the successive recording medium P enters the secondary transfer nip N. With this configuration, in an image forming apparatus with a fast processing speed in which the speed at which the sheet interval area between the preceding recording medium P and the successive recording medium P passes through the secondary transfer nip N is fast, the subsequent operation can be carried out without delay.

Similar to the recording medium P of the thickness group Z, when printing out the recording media P of other thickness groups α, β, and γ, the cam position of the eccentric cam 31 when the preceding recording medium P exits the secondary transfer nip N coincides with the cam position of the eccentric cam 31 when the successive recording medium P enters the secondary transfer nip N. Accordingly, even when the sheet interval between the preceding recording medium P and the successive recording medium P is relatively short, the subsequent operation can be carried out without delay.

More specifically, when using the recording medium P of the thickness group β, the cam position of the eccentric cam 31 is changed from the cam position B during the transfer process to the cam position C when the recording medium P exits the secondary transfer nip N in the following manner.

That is, the eccentric cam 31 shown in FIG. 7 during the transfer process is rotated in the clockwise direction to change the cam position from the cam position B to the cam position C. When the recording medium P exits the secondary transfer nip N, the eccentric cam 31 is positioned at the cam position C.

When using the recording medium P of the thickness group γ, the cam position of the eccentric cam 31 is changed from the cam position B during the transfer process to the cam position C when the recording medium P exits the secondary transfer nip N in the following manner.

That is, the eccentric cam 31 shown in FIG. 7 during the transfer process is rotated in the counterclockwise direction to change the cam position from the cam position B to the cam position A and to the cam position C. When the recording medium P exits the secondary transfer nip N, the eccentric cam 31 is positioned at the cam position C.

With this configuration, as can be understood from the cam diagram in FIG. 9, immediately after the intermediate transfer belt 131 and the secondary transfer roller 135 are separated from each other by a large amount by the eccentric cam 31 at the cam position A, the eccentric cam 31 is moved to the cam position C.

With this configuration, when the recording medium P exits the secondary transfer nip N, the size of the space between the intermediate transfer belt 131 and the secondary transfer roller 135 is changed from the large space to the small space in a shorter period of time, as compared with stopping the eccentric cam 31 temporarily at the cam position A, and then moving the eccentric cam 31 to the cam position C.

In order to facilitate an understanding of the novel features of the present invention, as a comparison, a description is provided of a comparative example of an image forming apparatus.

As described above, the intermediate transfer belt and the secondary transfer roller are spaced apart a certain distance in accordance with a thickness of the recording medium such that the impact is reduced as much as possible when the intermediate transfer belt and the secondary transfer roller come in contact with each other and the transfer pressure is zero when the recording medium enters and exits the secondary transfer nip. With this configuration, the impact is reduced when the intermediate transfer belt and the secondary transfer roller come in contact with each other and hence shock jitter is reduced without separating the intermediate transfer belt and the secondary transfer roller in accordance with the thickness of the recording medium more than necessary.

When performing continuous printing in which images are formed on a plurality of recording media, the recording media generally have the same thickness, but there may be a case in which recording media with different thicknesses may be used during continuous printing. In this case, if the thickness of a successive sheet is different from the thickness of a preceding sheet, after the preceding sheet exits the secondary transfer nip but during a time in which a sheet interval area, i.e., an area between the preceding sheet and the successive sheet, passes through the secondary transfer nip, the space between the intermediate transfer belt and the secondary transfer roller is changed in accordance with the thickness of the successive sheet.

However, in an image forming apparatus with a fast process linear velocity, the interval between the preceding sheet and the successive sheet is significantly short. As a result, the contact-and-separation device cannot change the size of the space between the intermediate transfer belt and the secondary transfer roller in accordance with the thickness of the successive sheet while the sheet interval area between the preceding sheet and the successive sheet passes through the secondary transfer nip. That is, the space between the intermediate transfer belt and the secondary transfer roller cannot be changed before the successive sheet enters the secondary transfer nip.

Consequently, the impact cannot be reduced when the successive recording medium enters the secondary transfer nip and also when the intermediate transfer belt and the secondary transfer roller come in contact, hence failing to prevent shock jitter.

To address such a difficulty, the sheet interval area between the preceding sheet and the successive sheet may be increased so that the contact-and-separation device can change the space between the intermediate transfer belt and the secondary transfer nip before the successive sheet enters the secondary transfer nip. However, a wider sheet interval area between the preceding sheet and the successive sheet decreases productivity in the continuous printing.

In view of the above, there is demand for an image forming apparatus capable of reducing shock jitter while maintaining good productivity in continuous printing.

When performing continuous printing in which images are formed on a plurality of recording media, the recording media generally have the same thickness, but there may be a case in which recording media with different thicknesses may be used during continuous printing. When the recording media P that belong to different thickness groups are printed out continuously, the cam position of the eccentric cam 31 when the preceding recording medium P exits the secondary transfer nip N differs from the cam position of the eccentric cam 31 when the successive recording medium P enters the secondary transfer nip N.

Consequently, the cam position of the eccentric cam 31 when the preceding recording medium P exits the secondary transfer nip N may be changed to the cam position of the eccentric cam 31 for the successive recording medium P before the successive recording medium P enters the secondary transfer nip N. In other words, the cam position cannot be changed while the sheet interval area passes through the secondary transfer nip N.

For example, assuming that the preceding recording medium P (first sheet) belonging to the thickness group α and the successive recording medium P (second sheet) belonging to the thickness group β are printed out consecutively, the cam position of the eccentric cam 31 for the preceding recording medium P (first sheet) of the thickness group α is at the cam position B when the recording medium P (first sheet) enters the secondary transfer nip N. During the transfer process, the eccentric cam 31 is at the cam position B. When the recording medium P exits the secondary transfer nip N, the eccentric cam 31 is at the cam position B.

When printing out the successive recording medium P (second sheet) of the thickness group β, it is necessary to change the cam position of the eccentric cam 31 from the cam position B to the cam position C by the time the successive recording medium P enters the secondary transfer nip N. Therefore, it is necessary to rotate the eccentric cam 31 from the cam position B to the cam position C while the sheet interval area between the preceding recording medium P (first sheet) and the successive recording medium P (second sheet) passes through the secondary transfer nip N. However, in the image forming apparatus with a fast processing speed, the speed at which the sheet interval area between the preceding recording medium P and the successive recording medium P passes through the secondary transfer nip N is so fast that the cam position of the eccentric cam 31 cannot be changed from the cam position B to the cam position C without delay.

To address this difficulty, the sheet interval between the preceding recording medium P and the successive recording medium P may be increased when printing out recording media of different thickness groups, but the printing productivity decreases. In view of the above, in the image forming apparatus 1 according to the present illustrative embodiment, when printing out consecutively recording media P that belong to different thickness groups, the size of the space between the intermediate transfer belt 131 and the secondary transfer roller 135 when the preceding recording medium P exits the secondary transfer nip N corresponds to the size of the space associated with the thickness group to which the successive recording medium P belongs when the successive recording medium P enters the secondary transfer nip N.

With this configuration, the space when the preceding recording medium P exits the secondary transfer nip N coincides with the space when the successive recording medium P enters the secondary transfer nip N.

Consequently, the cam position of the eccentric cam 31 when the preceding recording medium P exits the secondary transfer nip N can be changed reliably to the cam position of the eccentric cam 31 for the successive recording medium P before the successive recording medium P enters the secondary transfer nip N. In other words, the cam position of the eccentric cam 31 is changed while the sheet interval area between the preceding recording medium P and the successive recording medium P passes through the secondary transfer nip N. This configuration does not require extension of the sheet interval area when printing out consecutively recording media P of different thickness groups, hence preventing degradation of the productivity.

FIG. 11 is a table showing relations of the thickness groups and the cam positions of the eccentric cam 31 at times, i.e., when the recording medium P enters the secondary transfer nip N, during the transfer process, and when the recording medium P exits the secondary transfer nip N in the event in which the recording media P belonging to different thickness groups are printed out consecutively.

In FIG. 11, the first row lists the thickness groups of the successive recording medium P. The left column lists the thickness groups of the preceding recording medium P.

For example, when the preceding recording medium P belongs to the thickness group β and the successive recording medium P belongs to the thickness group α, the eccentric cam 31 is positioned at the cam position C when the preceding recording medium P (first sheet) enters the secondary transfer nip N. During the transfer process, the eccentric cam 31 is positioned at the cam position B. When the recording medium P exits the secondary transfer nip N, the eccentric cam 31 is positioned at the cam position B.

Under normal circumstances, when the recording medium P of the group β exits the secondary transfer nip N, the eccentric cam 31 is situated at the cam position C as shown in Table 2. However, because the successive recording medium P belongs to the thickness group α, the eccentric cam 31 is situated at the cam position B when the successive recording medium P enters the secondary transfer nip N as shown in Table 2. Thus, when the preceding recording medium P exits the secondary transfer nip N, the cam position of the eccentric cam 31 is changed to the cam position B.

With this configuration, the cam position of the eccentric cam 31 when the preceding recording medium P exits the secondary transfer nip N coincides with the cam position of the eccentric cam 31 when the successive recording medium P enters the secondary transfer nip N. That is, the eccentric cam 31 is situated at the cam position B when the preceding recording medium P exits the secondary transfer nip N as well as when the successive recording medium P enters the secondary transfer nip N.

This configuration does not need to change the space between the intermediate transfer belt 131 and the secondary transfer roller 135 while the sheet interval area passes through the secondary transfer nip N, thereby enabling consecutive printing using recording media with different thicknesses in the high-speed image forming apparatus without degrading the productivity.

Similar to the above-described combination of the thickness groups, for other combinations of the thickness groups in FIG. 11, the size of the space when the preceding recording medium P passes through the secondary transfer nip N is changed to the size of the space corresponding to the thickness group of the successive recording medium P when the successive recording medium P enters the secondary transfer nip N.

When printing out consecutively recording media belonging to different thickness groups, the eccentric cam 31 is rotated as described above, thereby reducing the shock jitter without degrading the productivity even when the sheet interval is very short such as in the high-speed image forming apparatus.

It is to be noted that the reason for changing the space when the preceding recording medium P exits the secondary transfer nip N in accordance with the thickness group of the successive recording medium P is that the factor that promotes the shock jitter is less when the recording medium P exits the secondary transfer nip N than when the recording medium P enters the secondary transfer nip N.

Therefore, the space between the intermediate transfer belt 131 and the secondary transfer roller 135 is set such that the relations between the space when the successive recording medium P enters the secondary transfer nip N and the thickness group (thickness) of the successive recording medium P are always ensured. This configuration can reduce the shock jitter more effectively as compared with setting the space to maintain the relations between the space when the preceding recording medium P exits the secondary transfer nip N and the thickness group of the preceding recording medium P.

Alternatively, in some embodiments, the space when the successive recording medium P (second sheet) enters the secondary transfer nip N may be set in accordance with the thickness group of the preceding recording medium P (first sheet). This configuration also enables consecutive printing of recording media P that belong to different thickness groups without degrading the productivity. In this case, the relations between the space when the preceding recording medium P exits the secondary transfer nip N and the thickness group (thickness) are always ensured.

Thus, this configuration prevents more reliably the image density near the trailing edge of the preceding recording medium P from changing, as compared with the configuration that ensures the relations between the space when the successive recording medium P enters the secondary transfer nip N and the thickness group (thickness). A good printing result can be expected if more emphasis is given to the image near the trailing edge of the recording medium P than the image near the leading edge of the recording medium P.

Figure 10:
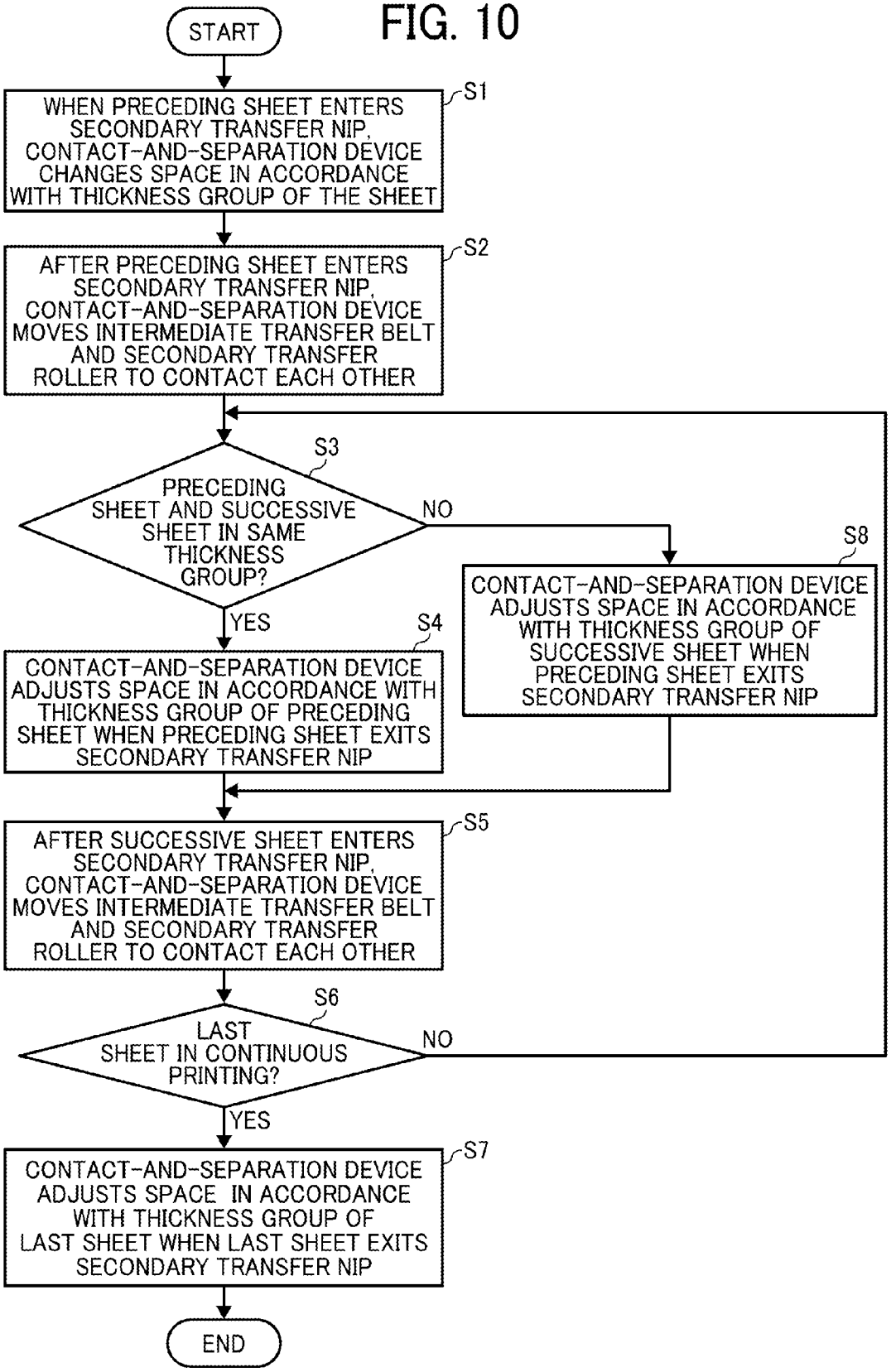
FIG. 10 is a flowchart showing steps of control of an intermediate transfer belt and a secondary transfer roller during continuous printing according to illustrative embodiment of the present disclosure.

FIG. 10 is a flowchart showing steps of control of movement of the intermediate transfer belt 131 and the secondary transfer roller 135 during continuous printing according to illustrative embodiment of the present disclosure. In this control, as described above, the thickness group of the recording medium P is specified based on the detection result provided by the thickness detector 160 and input by users using the operation panel 170 In accordance with the specified thickness group information, the controller 200 controls the contact-and-separation device 30.

As illustrated in FIG. 10, upon start of continuous printing (START), the space between the intermediate transfer belt 131 and the secondary transfer roller 135 when the preceding recording medium P (the first sheet) enters the secondary transfer nip N is formed in accordance with the thickness group of the preceding recording medium P by the contact-and-separation device 30 at step S1. Subsequently, at step S2, after the preceding recording medium P enters the secondary transfer nip N, the contact-and-separation device 30 moves the intermediate transfer belt 131 and the secondary transfer roller 135 to contact each other.

It is to be noted that if the intermediate transfer belt 131 and the secondary transfer roller 135 are not separated, that is, they are in contact with each other when the preceding recording medium P enters the secondary transfer nip N, the intermediate transfer belt 131 and the secondary transfer roller 135 remain in contact with each other.

Subsequently, at step S3, whether or not the thickness group of the successive recording medium P (the second sheet) coincides with the thickness group of the preceding recording medium P (first sheet) is determined. If the thickness group of the successive recording medium P (the second sheet) is the same as the thickness group of the preceding recording medium P (Yes at S3), the space when the preceding recording medium P exits the secondary transfer nip N is formed in accordance with the thickness group of the preceding recording medium P by the contact-and-separation device 30 at step S4.

If the thickness group of the successive recording medium P (the second sheet) does not coincide with the thickness group of the preceding recording medium P (No at S3), the space when the preceding recording medium P exits the secondary transfer nip N is formed in accordance with the thickness group of the successive recording medium P by the contact-and-separation device 30 at step S8.

Subsequently, at step S5, after the successive recording medium P enters the secondary transfer nip N, the contact-and-separation device 30 moves the intermediate transfer belt 131 and the secondary transfer roller 135 to contact each other. Then, at step S6, whether or not the recording medium P in the secondary transfer nip N is the last sheet of the recording medium P in the continuous printing is determined.

If the recording medium P in the secondary transfer nip N is not the last sheet in the continuous printing (No at S6), the recording medium P in the secondary transfer nip N (the second sheet) is now treated as the preceding recording medium P, and the subsequent recording medium P (the third sheet) delivered to the secondary transfer nip N is treated as the successive recording medium P. Accordingly, the above-described series of control is performed repeatedly as needed.

If the recording medium P in the secondary transfer nip N is the last sheet in the continuous printing (Yes at S6), the space when the last sheet of the recording medium P exits the secondary transfer nip N is formed in accordance with the thickness group of this last sheet by the contact-and-separation device 30 at step S7, and the contact-and-separation control in the continuous printing is ended.

Although the embodiment of the present disclosure has been described above, the present disclosure is not limited to the foregoing embodiments, but a variety of modifications can naturally be made within the scope of the present disclosure.

[Aspect A]

An image forming apparatus includes an image bearer such as the intermediate transfer belt 131 to bear a toner image on a surface of the image bearer, a nip forming device such as the secondary transfer roller 135 to contact the image bearer to form a transfer nip such as the secondary transfer nip N between the nip forming device and the image bearer and interpose a recording medium therebetween to transfer the toner image from the image bearer onto the recording medium in the transfer nip, a contact-and-separation device such as the contact-and-separation device 30 to move the image bearer and the nip forming device to contact and separate from each other, a thickness information retrieving device such as the thickness detector 160 to obtain information on a thickness of the recording medium, a controller such as the controller 200 to control the contact-and-separation device based on the information on the thickness of the recording medium such that in a case in which a thickness of a preceding recording medium and a thickness of a successive recording medium are different in continuous printing in which a plurality of recording media is printed out continuously, a space between the image bearer and the nip forming device when the preceding recording medium exits the transfer nip is adjusted by the contact-and-separation device to a preset size corresponding to the thickness of the successive recording medium entering the transfer nip.

According to Aspect A, in a case in which the thickness of the preceding recording medium and the thickness of the successive recording medium are different, the size of the space when the preceding recording medium exits the transfer nip is adjusted to the size corresponding to the thickness of the successive recording medium when the successive recording medium enters the transfer nip.

With this configuration, it is not necessary to change the size of the space between the image bearer and the nip forming device corresponding to the thickness of the preceding recording medium to the size corresponding to the thickness of the successive recording medium while the sheet interval area passes through the transfer nip in order to reduce the impact produced by the successive recording medium entering the transfer nip.

Furthermore, even when the sheet interval area is relatively short to increase productivity in the continuous printing, the space can be adjusted to the size corresponding to the thickness of the successive recording medium when the successive recording medium enters the transfer nip.

With this configuration, in a case in which recording media having different thicknesses are printed out continuously, the shock jitter caused by the impact that is produced when the successive recording medium enters the secondary transfer nip N and the impact that is produced when image bearer and the nip forming device come in contact can be reduced without increasing the sheet interval area. The productivity in the continuous printing is thus maintained.

[Aspect B]

According to Aspect A, the image forming apparatus includes a support roller such as the secondary-transfer opposed roller 136 including a rotary shaft disposed opposite to the nip forming device via the image bearer to rotatably support the image bearer to form the transfer nip. The nip forming device is a roller rotatable about a rotary shaft, and the image bearer is a belt. The contact-and-separation device includes a contact device such as the ball bearing 32 disposed on one of the rotary shaft of the support roller and the rotary shaft of the nip forming device, an eccentric cam such as the eccentric cam 31 disposed on the other of the rotary shaft of the support roller and the rotary shaft of the nip forming device, a cam controller such as the stepping motor 33 to rotate the eccentric cam to at least three different positions to change the size of the space between the image bearer and the nip forming device, and a biasing device such as the spring 37 to bias the contact device in a direction in which the support roller and the nip forming device contact each other. The cam controller rotates the eccentric cam to contact and move the contact device in a direction in which the image bearer and the nip forming device are separated from each other against a pressure from the biasing device, to form the space between the image bearer and the nip forming device. The cam controller rotates the eccentric cam to separate from the contact device while facing the contact device and move the contact device in a direction in which the image bearer and the nip forming device approach each other such that the support roller and the nip forming device contact each other via the image bearer with the pressure from the biasing device to form the transfer nip.

With this configuration, as described above, rotation of the eccentric cam for position adjustment is completed within the sheet interval area, hence reliably maintaining the productivity in the continuous printing and reducing shock jitter.

[Aspect C]

According to Aspect A or Aspect B, in a case in which recording media having the same thickness are printed out continuously, the controller controls the contact-and-separation device based on the information on the thickness obtained by the thickness information retrieving device to adjust the space between the image bearer and the nip forming device when the preceding recording medium enters the transfer nip and when the successive recording medium exits the transfer nip, to a preset size corresponding to the recording medium. With this configuration, as described above, the impact of the recording medium P when the recording medium P enters and exits the secondary transfer nip N and the impact of the secondary transfer roller 135 and the intermediate transfer belt 131 coming in contact with each other when they are separated can be minimized, hence reducing shock jitter and hence achieving good imaging quality.

[Aspect D]

According to Aspect B or Aspect C, the thickness information retrieving device is a thickness detector such as the thickness detector 160 that detects a thickness of the recording medium on a paper delivery path such as the paper delivery path 123. With this configuration, the thickness of the recording medium can be detected automatically upon continuous printing, and the size of the space is set accordingly.

[Aspect E]

According to any one of aspects A through C, the thickness information retrieving device includes an input device such as the operation panel 170 through which users input information on the thickness of the recording medium P.

With this configuration, the space is set based on the information input by the users.

According to an aspect of this disclosure, the present invention is employed in the image forming apparatus. The image forming apparatus includes, but is not limited to, an electrophotographic image forming apparatus, a copier, a printer, a facsimile machine, and a digital multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Each of the functions of the described embodiments may be implemented by one or more processing circuits. A processing circuit includes a programmed processor, as a processor includes a circuitry. A processing circuit also includes devices such as an application specific integrated circuit (ASIC) and conventional circuit components arranged to perform the recited functions.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

an image bearer configured to bear a toner image on a surface of the image bearer;

a nip forming device configured to contact the image bearer to form a transfer nip between the nip forming device and the image bearer and interpose a recording medium therebetween to transfer the toner image from the image bearer onto the recording medium in the transfer nip, the recording medium corresponding to at least one of three desired thickness groups;

a contact-and-separation device, including a stepping motor and an eccentric cam the contact-and-separation device configured to stop in at least three cam positions that provide at least three desired sizes corresponding to the at least three desired thickness groups between the image bearer and the nip forming device, and to move the image bearer and the nip forming device to contact and separate from each other;

a thickness information retrieving device configured to obtain information on a thickness of the recording medium;

a controller configured to control the stepping motor based on the information on the thickness of the recording medium such that in a case in which a thickness of a preceding recording medium and a thickness of a successive recording medium are in different thickness groups in continuous printing in which a plurality of recording media is printed out continuously, the controller is configured to control the stepping motor to adjust a space between the image bearer and the nip forming device when the preceding recording medium exits the transfer nip to one of the at least three desired sizes corresponding to the thickness group of the successive recording medium that enters the transfer nip; and the controller is configured to control the stepping motor to move the eccentric cam from a first cam position of the at least three cam positions to a second or third cam position before a trailing edge of the recording medium exits the transfer nip based on the information on the thickness of the recording medium.

2. The image forming apparatus according to claim 1, further comprising:

a support roller including a rotary shaft disposed opposite to the nip forming device via the image bearer configured to rotatably support the image bearer to form the transfer nip, wherein the nip forming device is a roller rotatable about a rotary shaft, and the image bearer is a belt, wherein the contact-and-separation device includes a contact device disposed on one of the rotary shaft of the support roller and the rotary shaft of the nip forming device, the eccentric cam disposed on the other of the rotary shaft of the support roller and the rotary shaft of the nip forming device, a cam controller configured to rotate the eccentric cam to the at least three different positions to change the size of the space between the image bearer and the nip forming device, and a biasing device configured to bias the contact device in a direction in which the support roller and the nip forming device contact each other, wherein the cam controller is configured to rotate the eccentric cam to contact and move the contact device in a direction in which the image bearer and the nip forming device are separated from each other against a pressure from the biasing device, to form the space between the image bearer and the nip forming device, and the cam controller is configured to rotate the eccentric cam to separate from the contact device while facing the contact device and move the contact device in a direction in which the image bearer and the nip forming device approach each other such that the support roller and the nip forming device contact each other via the image bearer with the pressure from the biasing device to form the transfer nip.

3. The image forming apparatus according to claim 1, wherein in a case in which recording media having the same thickness are printed out continuously, the controller is configured to controls the contact-and-separation device based on the information on the thickness obtained by the thickness information retrieving device to adjust the space between the image bearer and the nip forming device when the preceding recording medium enters the transfer nip and when the successive recording medium exits the transfer nip to the at least three different desired sizes corresponding to the thickness of the recording media.

4. The image forming apparatus according to claim 1, wherein the thickness information retrieving device is a thickness detector configured to detects the thickness of the recording medium on a recording medium delivery path.

5. The image forming apparatus according to claim 1, wherein the thickness information retrieving device includes an input device to input information on the thickness of the recording medium.

6. The image forming apparatus according to claim 5, wherein the input device is an operation panel.

7. The image forming apparatus according to claim 1, wherein the thickness detector includes a light emitting element and a light receiving element disposed opposite the light emitting element via the paper delivery path.

8. The image forming apparatus according to claim 1, wherein the controller is configured to adjust the cam position of the eccentric cam at different timings, including at recording medium entry, during recording medium printing, and upon recording medium sheet exit, based on the information on the thickness of the recording medium sheet.

9. The image forming apparatus according to claim 1, wherein the controller is further configured to control the stepping motor to move the eccentric cam from the first cam position of the at least three cam positions to the second or third cam position before the trailing edge of the preceding recording medium exits the transfer nip in accordance with the information on the thickness of the successive recording medium.

10. The image forming apparatus according to claim 1, wherein the image forming apparatus is configured to receive recording mediums with a plurality of thickness ranges, each of the plurality of thickness ranges associated with at least one of the cam positions, such that when each of the recording mediums is determined to fall within one of the thickness ranges, the cams rotate and stop at the cam position associated with the determined thickness range before the trailing edge of the first recording medium exits the transfer nip.

11. The image forming apparatus according to claim 1, wherein a traveling speed of the intermediate transfer belt is maintained when the recording medium enters and exits the transfer nip.

12. A method for forming an image in an image forming apparatus, the method comprising:

bearing a toner image on a surface of an image bearer;

forming a transfer nip between a nip forming device and the image bearer and interposing a recording medium therebetween to transfer the toner image from the image bearer onto the recording medium in the transfer nip, the recording medium corresponding to at least one of three desired thickness groups;

moving the image bearer and the nip forming device to contact and separate from each other using a contact-and-separation device;

obtaining information on a thickness of the recording medium using a thickness information retrieving device;

controlling the contact-and-separation device, the contact-and-separation device including a stepping motor and an eccentric cam and configured to stop in at least three cam positions that provide at least three desired sizes corresponding to the at least three desired thickness groups between the image bearer and the nip forming device, based on the information on the thickness of the recording medium such that in a case in which the thickness of a preceding recording medium and a thickness of a successive recording medium are different in, continuous printing in which a plurality of recording media is printed out continuously, controlling the stepping motor to adjust a space between the image bearer and the nip forming device when the preceding recording medium exits the transfer nip to one of the at least three desired sizes corresponding to the at least three desired thickness groups of the successive recording medium that enters the transfer nip; and controlling the stepping motor to move the eccentric cam from a first cam position of the at least three cam positions to a second or third cam position before a trailing edge of the recording medium exits the transfer nip based on the information on thickness of the recording medium.

13. The method according to claim 12, the method further comprising:

rotatably supporting the image bearer to form the transfer nip using a support roller, the support roller including a rotary shaft disposed opposite to the nip forming device via the image bearer;

wherein the nip forming device is a roller rotatable about a rotary shaft, and the image bearer is a belt;

wherein the contact-and-separation device includes a contact device disposed on one of the rotary shaft of the support roller and the rotary shaft of the nip forming device, the eccentric cam disposed on the other of the rotary shaft of the support roller and the rotary shaft of the nip forming device, a cam controller configured to rotate the eccentric cam to the at least three different positions to change the size of the space between the image bearer and the nip forming device, and a biasing device configured to bias the contact device in a direction in which the support roller and the nip forming device contact each other;

wherein the cam controller is configured to rotate the eccentric cam to contact and move the contact device in a direction in which the image bearer and the nip forming device are separated from each other against a pressure from the biasing device, to form the space between the image bearer and the nip forming device; and the cam controller is configured to rotate the eccentric cam to separate from the contact device while facing the contact device and move the contact device in a direction in which the image bearer and the nip forming device approach each other such that the support roller and the nip forming device contact each other via the image bearer with the pressure from the biasing device to form the transfer nip.

14. The method according to claim 12, the method further comprising:

controlling the contact-and-separation device based on the information on the thickness obtained by the thickness information retrieving device to adjust the space between the image bearer and the nip forming device when the preceding recording medium enters the transfer nip and when the successive recording medium exits the transfer nip to one of the at least three different desired sizes corresponding to the thickness of the recording media, in a case in which recording media having the same thickness are printed out continuously.

15. The method according to claim 12, wherein the thickness information retrieving device is a thickness detector, and the method further comprises:

detecting the thickness of the recording medium on a recording medium delivery path using the thickness information retrieving device.

16. The method according to claim 12, wherein the thickness information retrieving device includes an input device to input information on the thickness of the recording medium, and the method further comprises:

detecting the thickness of the recording medium on a recording medium delivery path using the thickness information input via the input device.

17. The method for forming an image in an image forming apparatus according to claim 12, wherein the controlling the stepping motor to move the eccentric cam from the first cam position of the at least three cam positions to the second or third cam position includes moving the eccentric cam before the trailing edge of the preceding recording medium exits the transfer nip in accordance with the information on thickness of the successive recording medium.

18. The method according to claim 12, wherein a traveling speed of the intermediate transfer belt is maintained when the recording medium enters and exits the transfer nip.

* * * * *